US007730689B2

(12) United States Patent
Figueroa-Morales

(10) Patent No.: US 7,730,689 B2
(45) Date of Patent: Jun. 8, 2010

(54) WINDOW ARRANGEMENT TO AID IN THE REDUCTION OF UNWANTED AIR MOVEMENT IN OR OUT OF WINDOWS

(75) Inventor: Carmen L. Figueroa-Morales, 702 Francisco García Faria St., Dorado, PR (US) 00646

(73) Assignee: Carmen L. Figueroa-Morales, Dorado, PR (US)

( * ) Notice: Subject to any disclaimer, the term of this patent is extended or adjusted under 35 U.S.C. 154(b) by 448 days.

(21) Appl. No.: 11/668,526

(22) Filed: Jan. 30, 2007

(65) Prior Publication Data

US 2008/0178548 A1 Jul. 31, 2008

(51) Int. Cl.
*E06B 7/08* (2006.01)
*E06B 3/26* (2006.01)
*E06B 9/08* (2006.01)

(52) U.S. Cl. ..... 52/473; 52/202; 160/98; 160/121.1; 160/265

(58) Field of Classification Search ..... 52/473, 52/202, 203; 160/31, 121.1, 305, 265, 266, 160/267.1, 67, 269, 273.1, 98
See application file for complete search history.

(56) References Cited

U.S. PATENT DOCUMENTS 2,564,770 A * 8/1951 Spencer ..... 160/271
3,116,097 A * 12/1963 Novales ..... 312/297
4,079,597 A * 3/1978 Lindner et al. ..... 192/142 R
4,125,142 A * 11/1978 Fohl ..... 160/291
4,131,150 A * 12/1978 Papadakis ..... 160/368.1
4,172,563 A * 10/1979 Werner et al. ..... 242/390.1
4,182,088 A * 1/1980 Ball ..... 52/202
4,238,969 A * 12/1980 Krause ..... 74/411.5
4,262,729 A * 4/1981 Von Knorring ..... 160/242
4,304,072 A * 12/1981 Pegg ..... 49/63
4,347,886 A * 9/1982 von Knorring ..... 160/242
4,399,855 A * 8/1983 Volfson ..... 160/23.1
4,419,982 A * 12/1983 Eckels ..... 126/625
4,436,137 A * 3/1984 Charles ..... 160/242
4,478,268 A * 10/1984 Palmer ..... 160/310
4,518,194 A * 5/1985 Kirkham et al. ..... 296/100.18
4,590,714 A * 5/1986 Walker ..... 250/585
4,688,351 A * 8/1987 Torres ..... 49/74.1
4,732,201 A * 3/1988 Dillitzer ..... 160/25
4,801,180 A * 1/1989 Styles ..... 312/115
4,813,183 A * 3/1989 Jordal ..... 49/74.1
4,846,248 A * 7/1989 Sonderby ..... 160/319
4,850,418 A * 7/1989 Bresson ..... 160/310
4,855,716 A * 8/1989 Jordal ..... 340/550
5,085,021 A * 2/1992 Kunert ..... 52/208
5,167,269 A * 12/1992 Abo ..... 160/305
5,343,922 A * 9/1994 Rankl et al. ..... 160/133
5,443,563 A * 8/1995 Hindel et al. ..... 160/238
5,445,209 A * 8/1995 Lichy ..... 160/273.1
5,482,104 A * 1/1996 Lichy ..... 160/273.1

(Continued)

*Primary Examiner*—Richard E Chilcot, Jr.
*Assistant Examiner*—James Ference
(74) *Attorney, Agent, or Firm*—Nils H. Ljungman & Associates

(57) ABSTRACT

A building having windows and a window arrangement to aid in the reduction of unwanted air movement in or out of windows or even doors. The window arrangement is configured to be combined with louvered or jalousie windows to minimize the flow of air from one side of the louvered or jalousie windows to the other side.

15 Claims, 19 Drawing Sheets

U.S. PATENT DOCUMENTS 5,575,114 A * 11/1996 Riegelman ..... 49/246
5,651,215 A * 7/1997 Riegelman ..... 49/246
5,682,937 A * 11/1997 Decrane et al. ..... 160/133
5,850,864 A * 12/1998 Decker ..... 160/268.1
5,899,021 A * 5/1999 Bastarache ..... 49/341
5,907,926 A * 6/1999 Sosa ..... 49/249
5,975,186 A * 11/1999 Day ..... 160/321
6,061,962 A * 5/2000 Sosa ..... 49/249
6,092,581 A * 7/2000 Andersson ..... 160/268.1
6,098,339 A * 8/2000 Rivera et al. ..... 49/74.1
6,125,905 A * 10/2000 Woodside et al. ..... 160/67
RE36,975 E * 12/2000 Williams ..... 52/19
6,212,913 B1 * 4/2001 Weiss ..... 66/172 R
6,296,039 B1 * 10/2001 Mullet et al. ..... 160/267.1
6,467,714 B1 * 10/2002 Rasmussen ..... 242/381
6,474,395 B2 * 11/2002 Weiss ..... 160/237
6,478,072 B1 * 11/2002 Allman ..... 160/89
6,691,761 B1 * 2/2004 Alkhoury et al. ..... 160/273.1
6,959,748 B2 * 11/2005 Hudoba ..... 160/31
6,971,435 B2 * 12/2005 Rasmussen ..... 160/321
7,104,010 B2 * 9/2006 Winner ..... 49/403
7,128,125 B2 * 10/2006 Harbison ..... 160/273.1
7,438,111 B2 * 10/2008 Grimes et al. ..... 160/23.1
2004/0144498 A1 * 7/2004 Hudoba et al. ..... 160/31
2007/0227084 A1 * 10/2007 Skobba ..... 52/202

* cited by examiner

WINDOW ARRANGEMENT TO AID IN THE REDUCTION OF UNWANTED AIR MOVEMENT IN OR OUT OF WINDOWS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This application relates to a building having windows and a window arrangement to aid in the reduction of unwanted air movement in or out of windows or even doors.

2. Description of Related Art including information disclosed under 37 CFR 1.97 and 1.98

Buildings have windows, and windows, especially when poorly sealed, can allow for unwanted drafts. Jalousie, or louvered, windows usually comprise a frame, often metal, and vertical slats of possibly glass, hard plastic material, or even metal which are angled in such a way as to admit light and air, but to keep out rain and direct sunlight. The louvers are usually operated by a crank mechanism, which tilts the slats open to allow a breeze to enter an interior area of a building, creating a sense of having the outside indoors. In many locations in the U.S. and around the world, jalousie windows have been installed as an inexpensive method of controlling the transfer of air between the inside and the outside of a building.

One advantage of jalousie windows is that they allow for ventilation, with air flowing freely from the outside to the inside of a building. Unfortunately, the overlapping louvers of the jalousie windows are very difficult to seal, and the cracks between the slats offer an avenue for air and moisture infiltration. As a result, jalousie windows are well-known for their energy inefficiency. By allowing the loss of heated or cooled air through the poorly-sealing louvers and metal frame, this type of window can contribute to unwanted drafts and costly energy bills. In fact, many building codes in the U.S. no longer allow the installation of jalousie windows in newly constructed buildings.

OBJECT OR OBJECTS

The object of at least one possible embodiment of the present application is to aid in the reduction of unwanted air movement in or out of windows or even doors in a building through the use of a window arrangement.

BRIEF SUMMARY OF THE INVENTION

At least one possible embodiment of the present application describes a building having windows and a window arrangement to aid in the reduction of unwanted air movement in or out of windows or even doors.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE SEVERAL VIEWS OF THE DRAWINGS

At least one possible embodiment is explained in greater detail below, which is illustrated in the accompanying drawings. In the drawings.

DETAILED DESCRIPTION OF THE INVENTION

Figure 1:
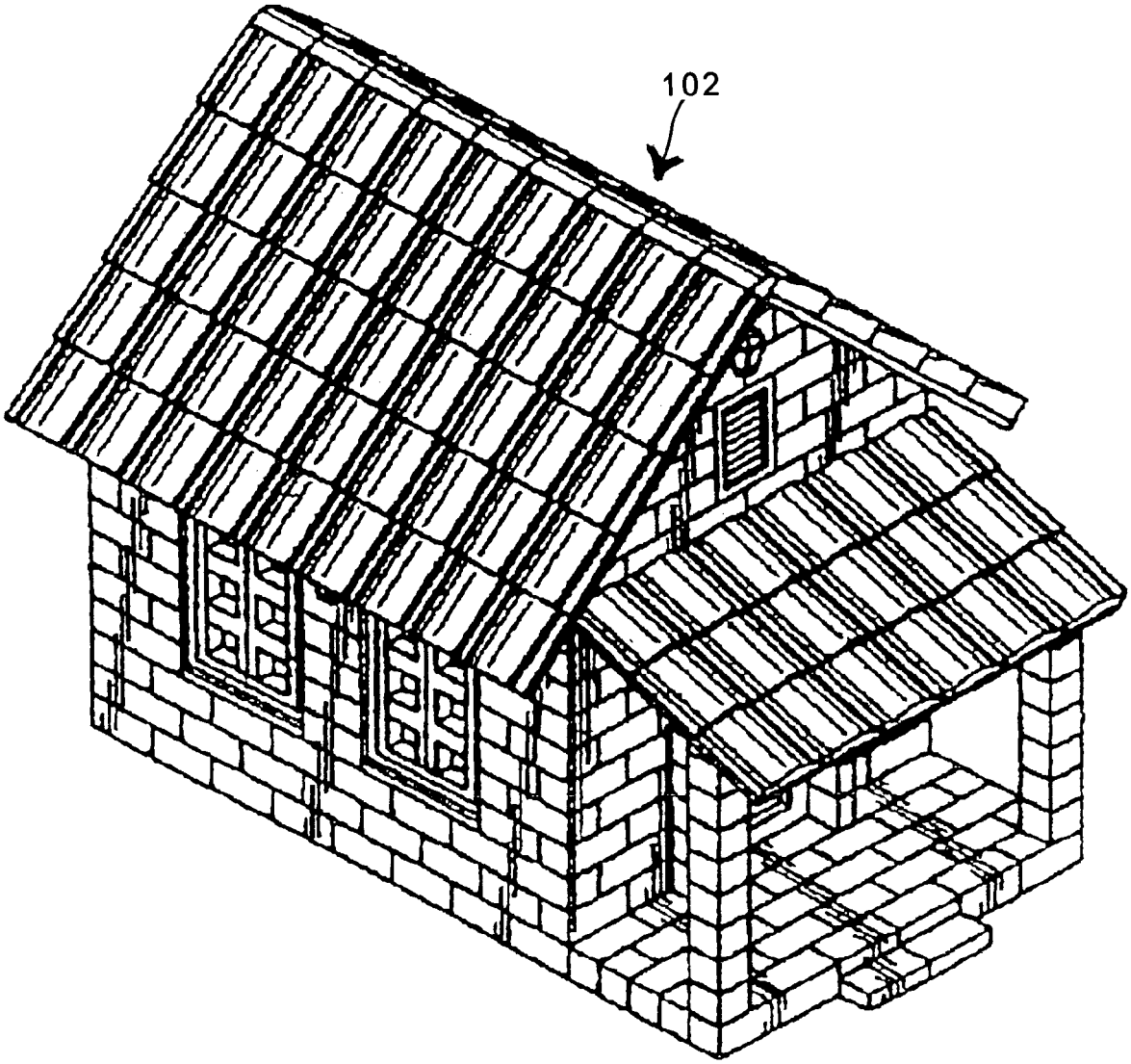
FIGS. 1 and 2 show buildings.
Figure 2:
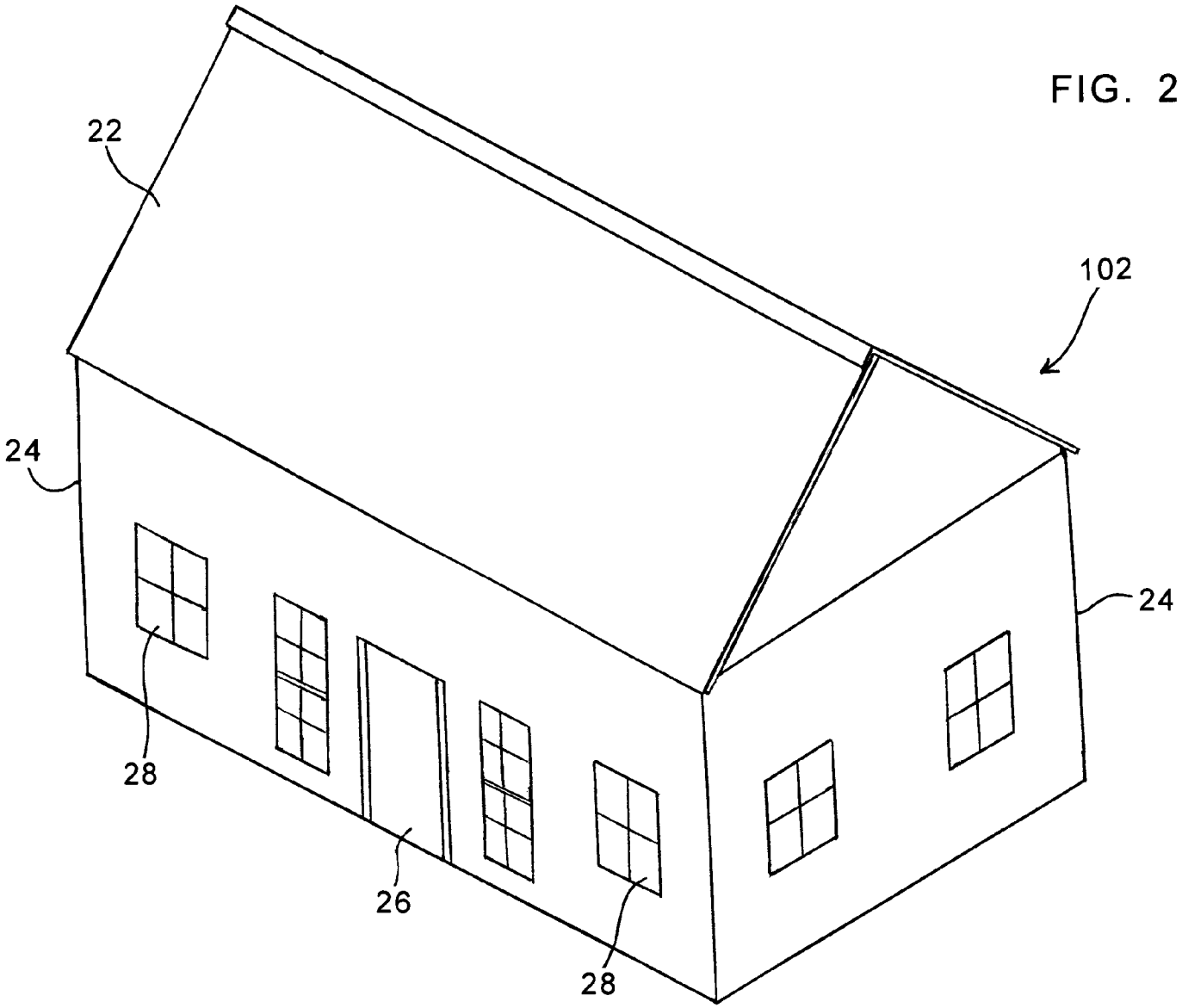

FIGS. 1 and 2 both show the main components of at least one possible embodiment of a building with windows, specifically, a building with windows having a window arrangement to aid in the reduction of unwanted air movement in or out of windows or even doors, in which window arrangement at least one aspect, or several aspects, of the embodiments disclosed herein, could possibly be utilized. FIGS. 1 and 2 each show a building 102.

FIG. 2 shows the building 102 with walls 24, a roof 22, a door 26, and windows 28.

Figure 3:
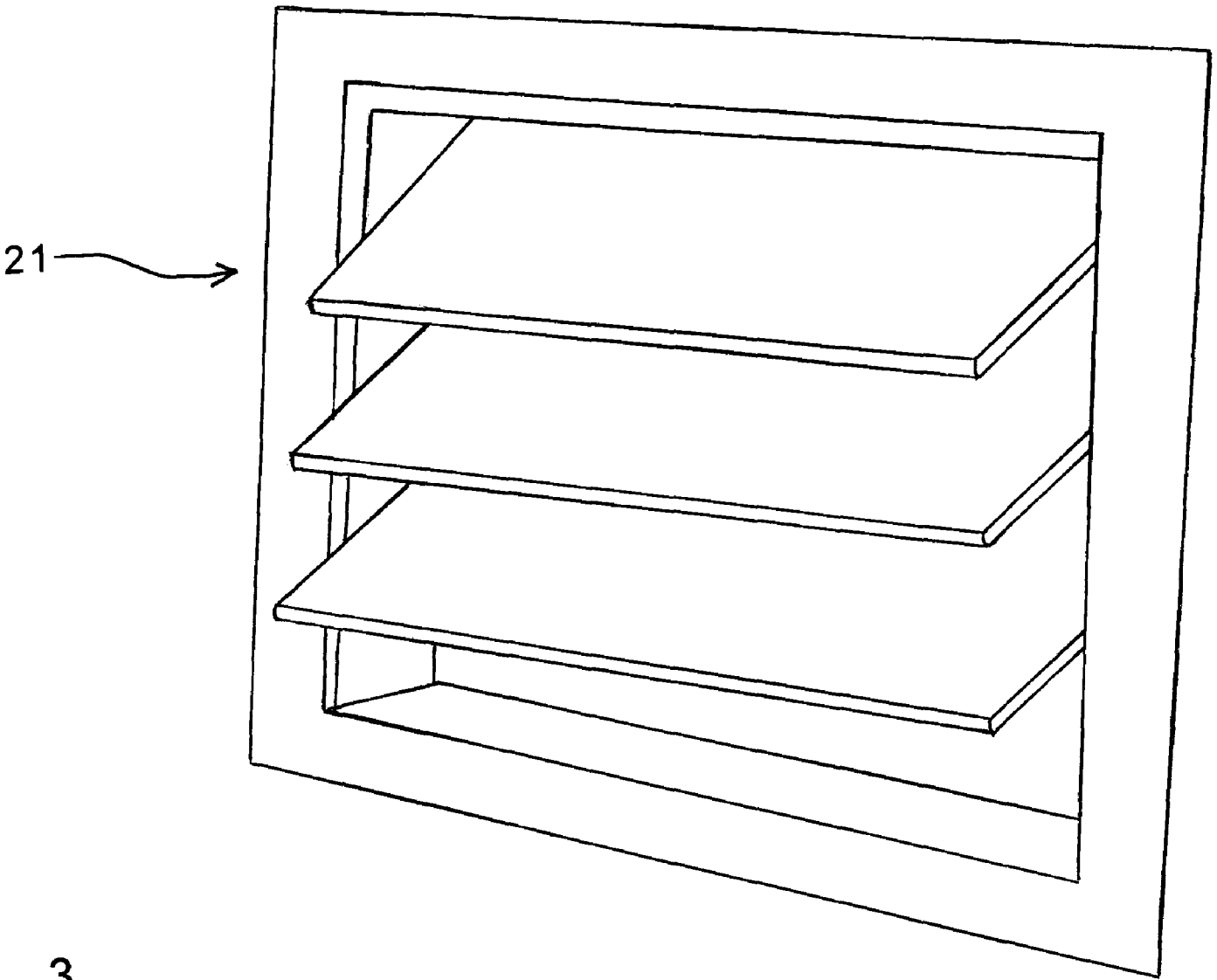
FIG. 3 shows a jalousie window.

FIG. 3 shows a jalousie window 21, in accordance with at least one possible embodiment, in which system could possibly be utilized at least one aspect, or several aspects, of the embodiments disclosed herein.

Figure 4:
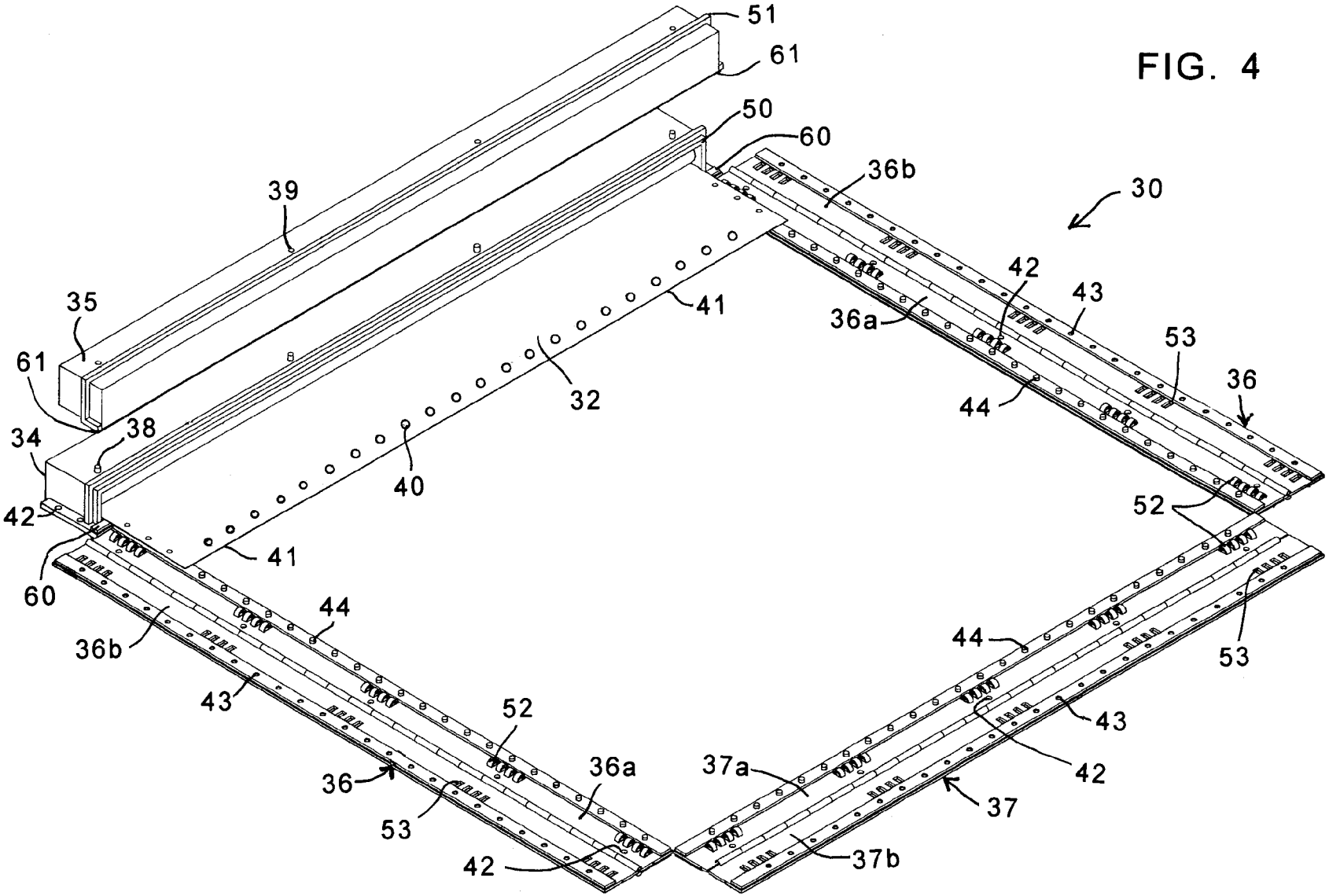
FIG. 4A shows an illustration of one possible embodiment of a window arrangement with a pull-down sheet member used to aid in the reduction of unwanted air movement in or out of windows or even doors reduce drafts through window or even door areas.

FIG. 4 is a window arrangement 30 with a retractable, pull-down sheet member 32, in accordance with at least one possible embodiment, in which arrangement could possibly be utilized at least one aspect, or several aspects, of the embodiments disclosed herein. The sheet member 32 could conceivably be made of a flexible, transparent plastic material. The sheet member 32 has small mooring holes 40 along its perimeter 41. A housing unit 34 encompasses the sheet member 32 while in a retracted position. In at least one possible embodiment, the housing unit 34 could possibly be made of aluminum.

Figure 4A:
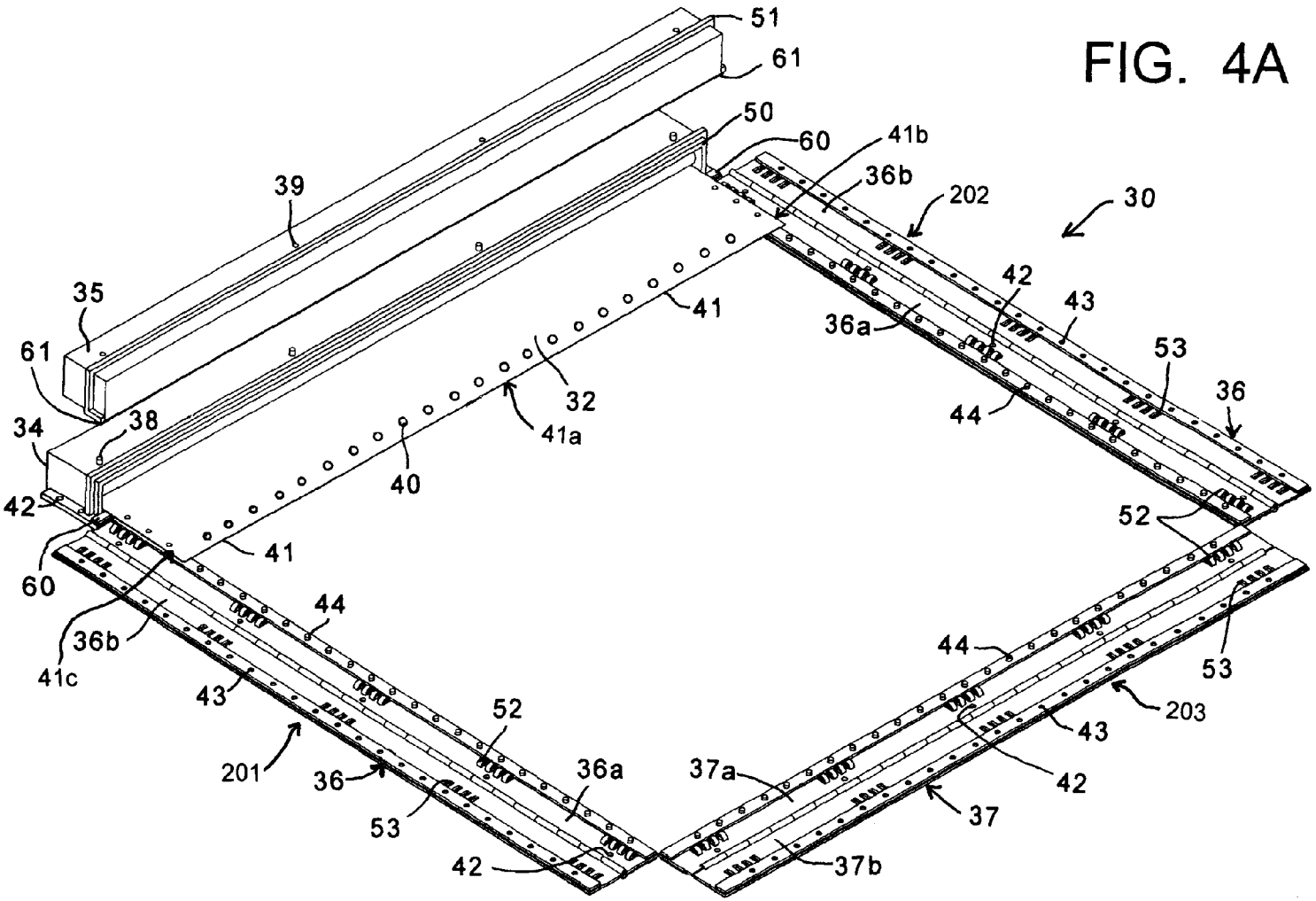

FIG. 4A shows the window arrangement 30, similar to that which is seen in FIG. 4, including a first peripheral edge 41*a* of the sheet member 32, a second peripheral edge 41*b* of the sheet member 32, and a third peripheral edge 41*c* of the sheet member 32. Also seen in FIG. 4A is a first peripheral edge 203 of the framing member 37, a second peripheral edge 202 of the frame comprising a frame member 36, and the third peripheral edge 201 of the frame comprising a frame member 36.

Two framing members 36 are positioned adjacent and essentially perpendicular to the housing unit 34. There is also another framing member 37 that is placed adjacent, but essentially perpendicular to each vertical frame member 36. The housing unit 34 and framing members 36 and 37 form a rectangle which encircles a window or door opening. In at least one possible embodiment, the framing members 36 and 37 could possibly be made of aluminum.

The framing members 36 and 37 have stationary leaf members 36*a* and 37*a* and folding leaf members 36*b* and 37*b*. The folding leaf members 36*b* and 37*b* fold over stationary leaf members 36*a* and 37*a* to lock the sheet member 32 in a stationary position.

When the sheet member 32 is pulled down and fully extended, the mooring holes 40 along its perimeter 41 fit over pegs 44 on the stationary leaf members 36*a* and 37*a*. Along the edge of the folding leaf members 36*b* and 37*b* are openings 43 which are designed to fit over pegs 44 on stationary leaf members 36*a* and 37*a* when folded. The folding leaf members 36*b* fold over stationary leaf members 36*a*, and folding leaf member 37*b* folds over stationary leaf member 37*a*, locking the sheet member 32 into a stationary position. In addition to the openings 43 and pegs 44, along the interior of the folding leaf members 36*b* and 37*b* are channels 53 which are configured to fit over arches 52 on stationary leaf members 36*a* and 37*a* when folded.

The framing members 36 and 37 have a length dimension which corresponds to the dimensions of the window frame. Stationary leaf members 36*a* and 37*a*, and folding leaf members 36*b* and 37*b* have width dimensions that are equal or essentially equal to one another. In at least one possible embodiment, the width dimension of the stationary leaf members 36*a* and 37*a*, and folding leaf members 36*b* and 37*b* may be approximately two inches wide. The length of the stationary leaf members and folding leaf members can vary depending on the dimensions of the window or door opening.

The housing unit 34 has a housing unit mating section 35. The housing unit 34 has studs 38, and the housing unit mating section 35 has holes 39. The studs 38 and holes 39 are arranged in a corresponding manner which enables the studs 38 and holes 39 to attach to one another. The studs 38 are placed in a linear fashion along the horizontal middle of the housing unit 34. The holes 39 are placed in a linear fashion along the horizontal middle of the housing unit mating section 35.

There is a crease 50 that extends the length of the front and side portions the housing unit 34, some centimeters below the aforementioned studs 38. Correspondingly, there is a ridge 51 that extends the length of the housing unit mating section 35, a small distance below the holes 39. The crease 50 and corresponding ridge 51 help to align the housing unit 34 and the housing unit mating section 35 when they are attached to each other by way of the studs 38 and holes 39.

The housing unit 34 has fastener openings 42 on the end portions of the length dimension, and the framing members 36 and 37 have fastener openings 42 disposed in and along the length dimensions of the stationary leaf members 36*a* and 37*a* for securing the housing unit 34 to a window or door frame. In at least one possible embodiment, the housing unit 34 may be secured to a window or door frame with screws, or other suitable fastening device.

The housing unit mating section 35 is meant to aid in concealing the sheet member 32 while in a retracted position. When the housing unit 34 and housing unit mating section 35 are attached to one another, aligning the studs 38 and crease 50 with the fastener openings 42 and ridge 51, they form a seal that prevents movement of the sheet member 32.

Additionally, there is weatherstripping 60 along the lower edge of the housing unit 34 and weatherstripping 61 along the lower edge of the housing unit mating section 35. When the housing unit 34 and the housing unit mating section 35 are attached to one another, by way of the studs 38 and the holes 39, the weatherstripping 60 and 61 form a seal on the "sandwiched" screen, thereby aiding in the prevention of air movement.

Figure 5:
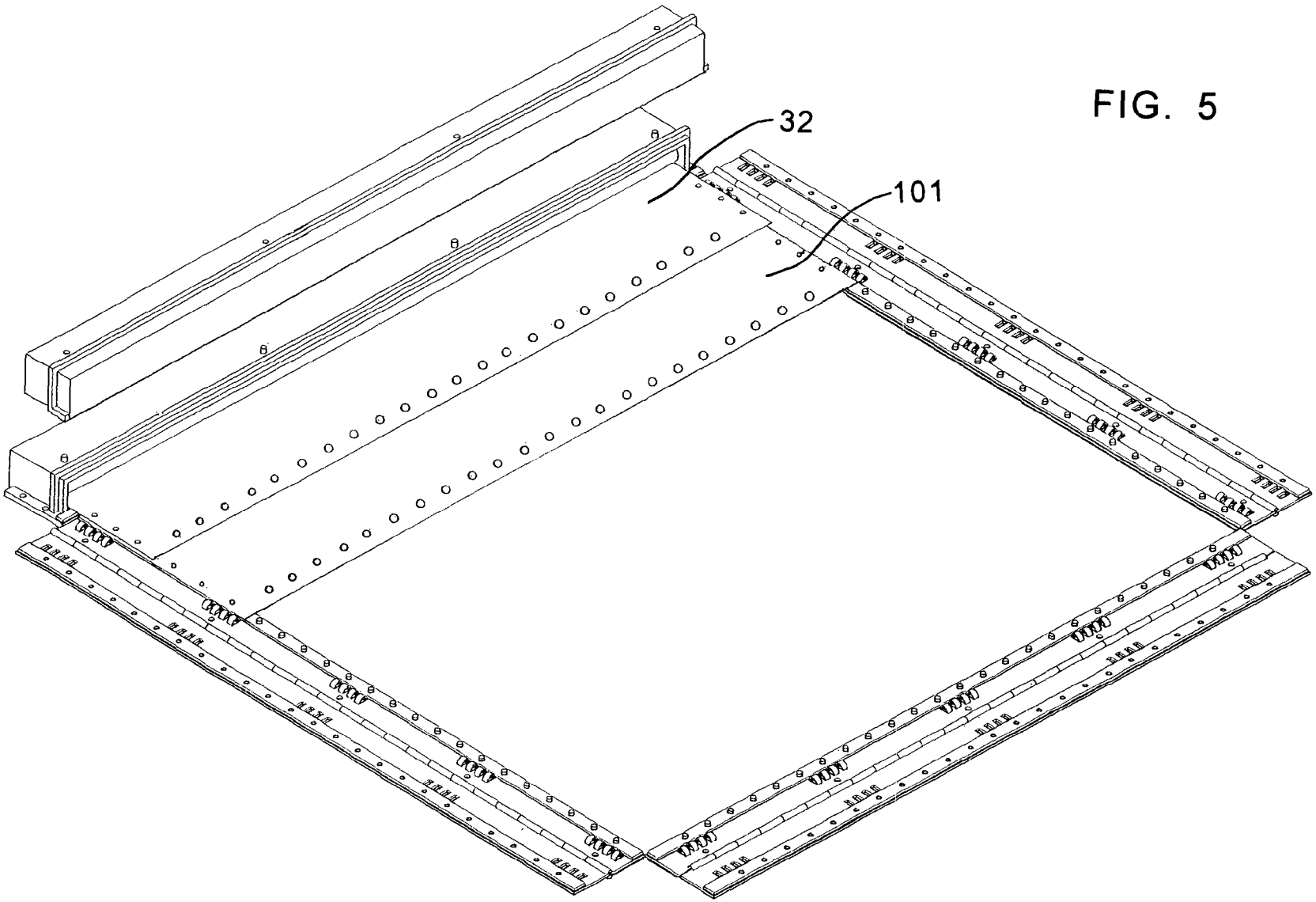
FIG. 5 shows a window arrangement with a transparent plastic sheet member and an opaque shade member.
Figure 6:
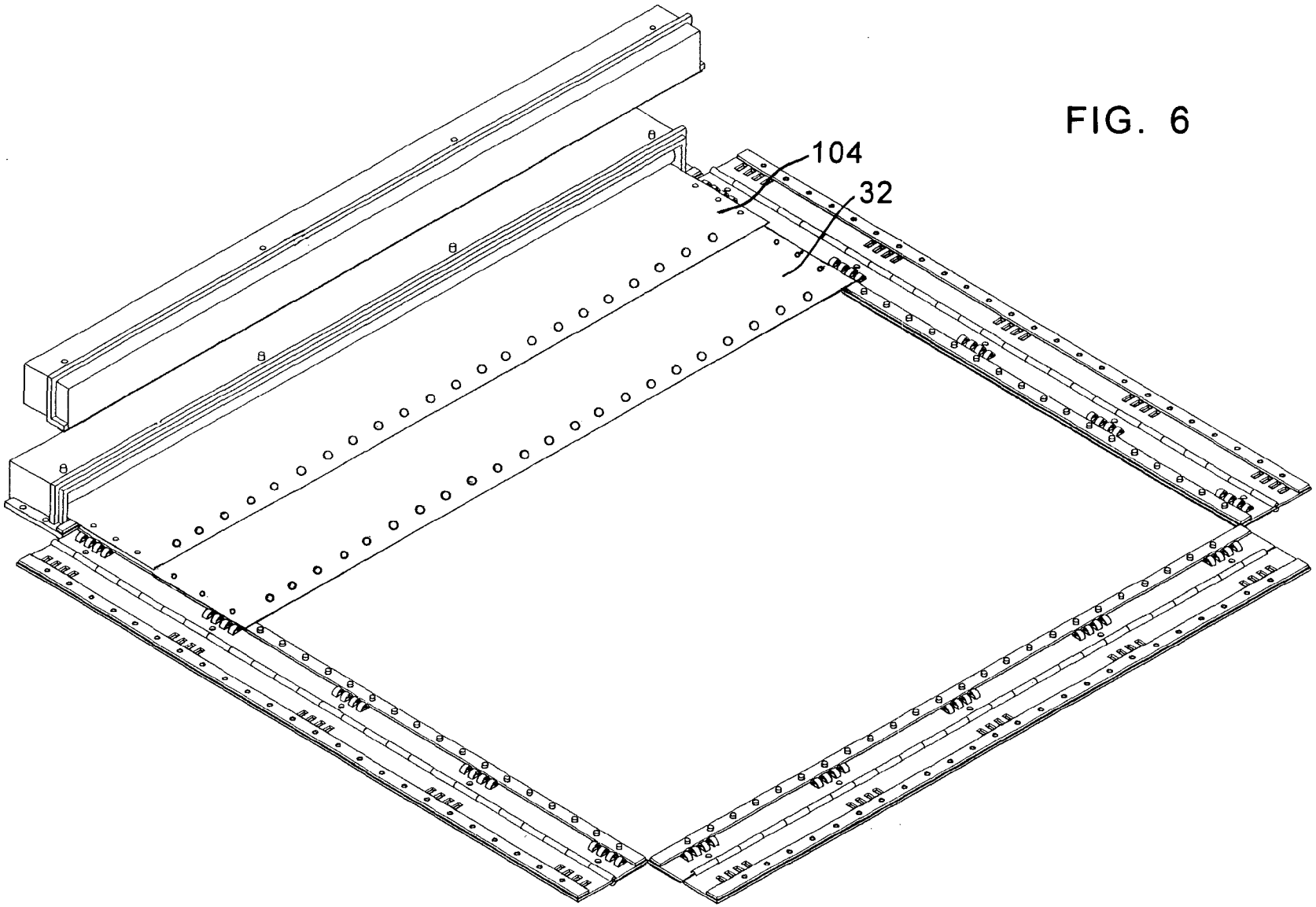
FIG. 6 shows a window arrangement with an air-permeable screen member and a transparent plastic sheet member.
Figure 7:
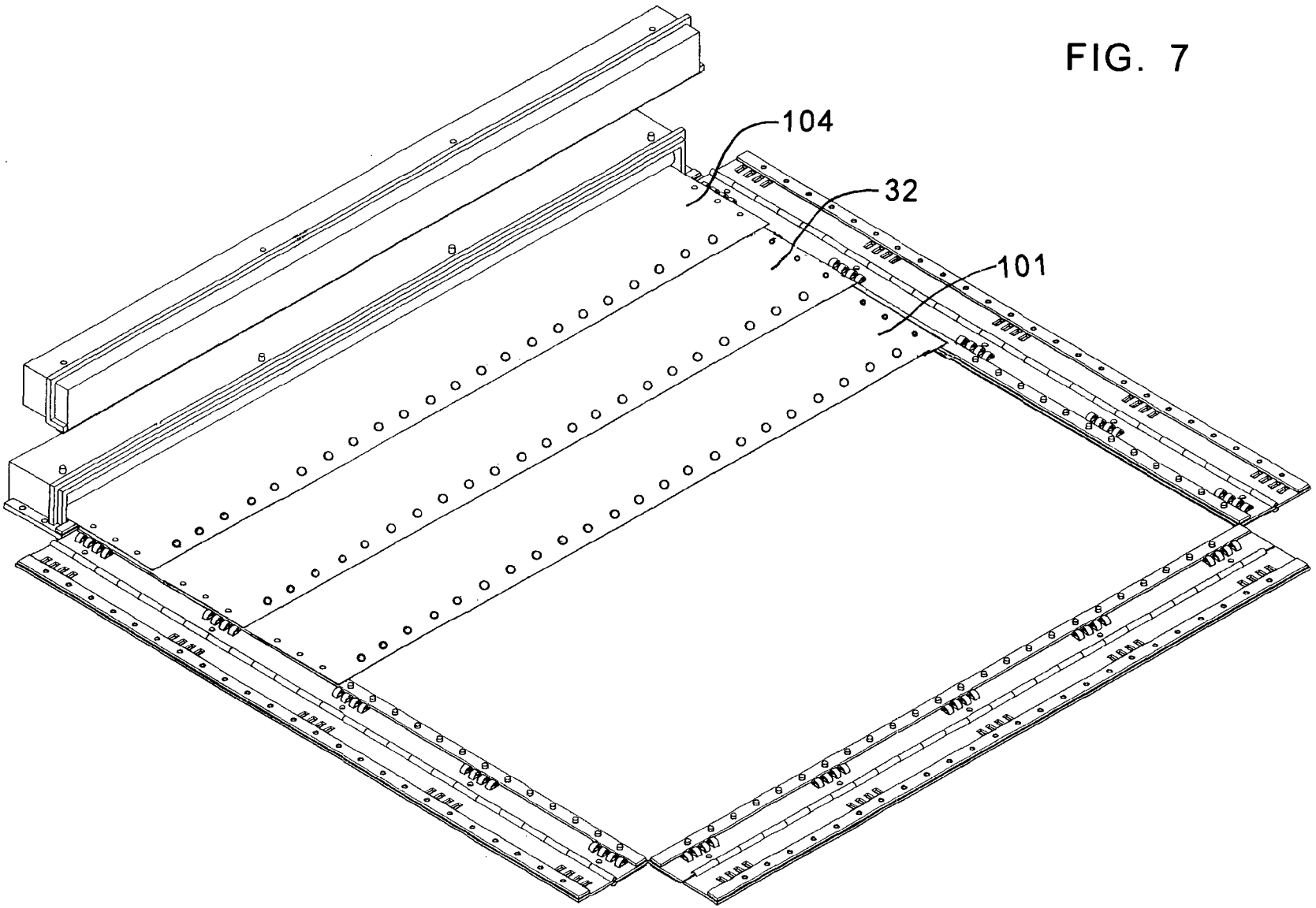
FIG. 7 shows a window arrangement with an air-permeable screen member, a transparent plastic sheet member and an opaque shade member.

In FIGS. 5, 6, and 7, window assemblies are shown with various types of sheet members.

FIG. 5 shows a pull-down sheet member 32, possibly made of transparent plastic, and a pull-down screen member 101, possibly made of an air-permeable mesh screen material, in accordance with at least one possible embodiment.

FIG. 6 shows a pull-down sheet member 32, possibly made of transparent plastic, and a pull-down shade member 104, possibly made of an opaque, light-blocking material, in accordance with at least one possible embodiment.

FIG. 7 shows a pull-down sheet member 32, possibly made of transparent plastic; a pull-down screen member 101, possibly made of an air-permeable mesh screen material; and a pull-down shade member 104, possibly made of an opaque, light-blocking material, in accordance with at least one possible embodiment.

Figure 7A:
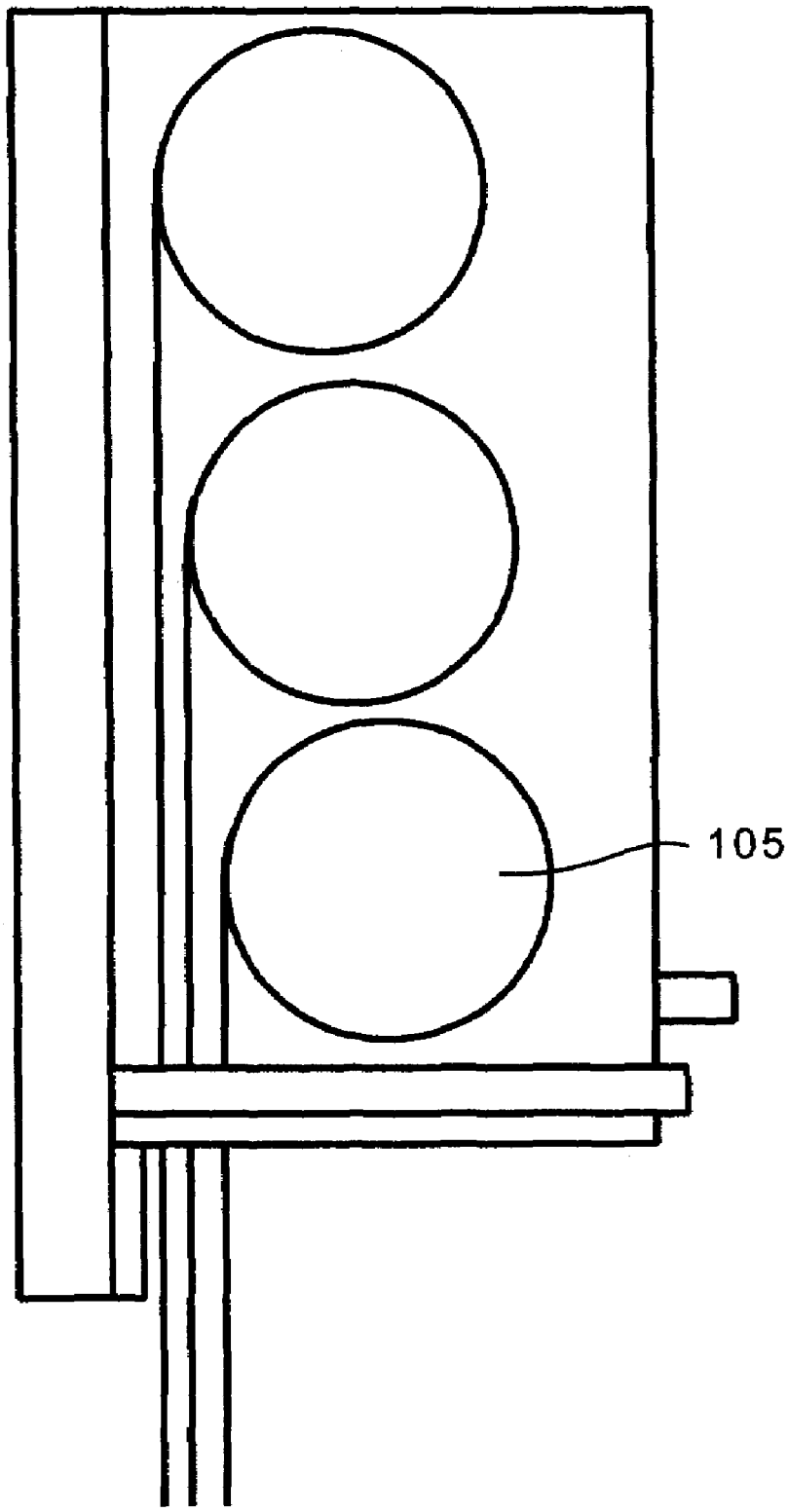
FIG. 7A shows a cross-section of a window arrangement housing unit with three roller mechanisms.

FIG. 7A shows three roller mechanisms 105 connected to a pull-down sheet member 32, possibly made of transparent plastic; a pull-down screen member 101, possibly made of an air-permeable mesh screen material; and a pull-down shade member 104, possibly made of an opaque, light-blocking material, in accordance with at least one possible embodiment.

Figure 8:
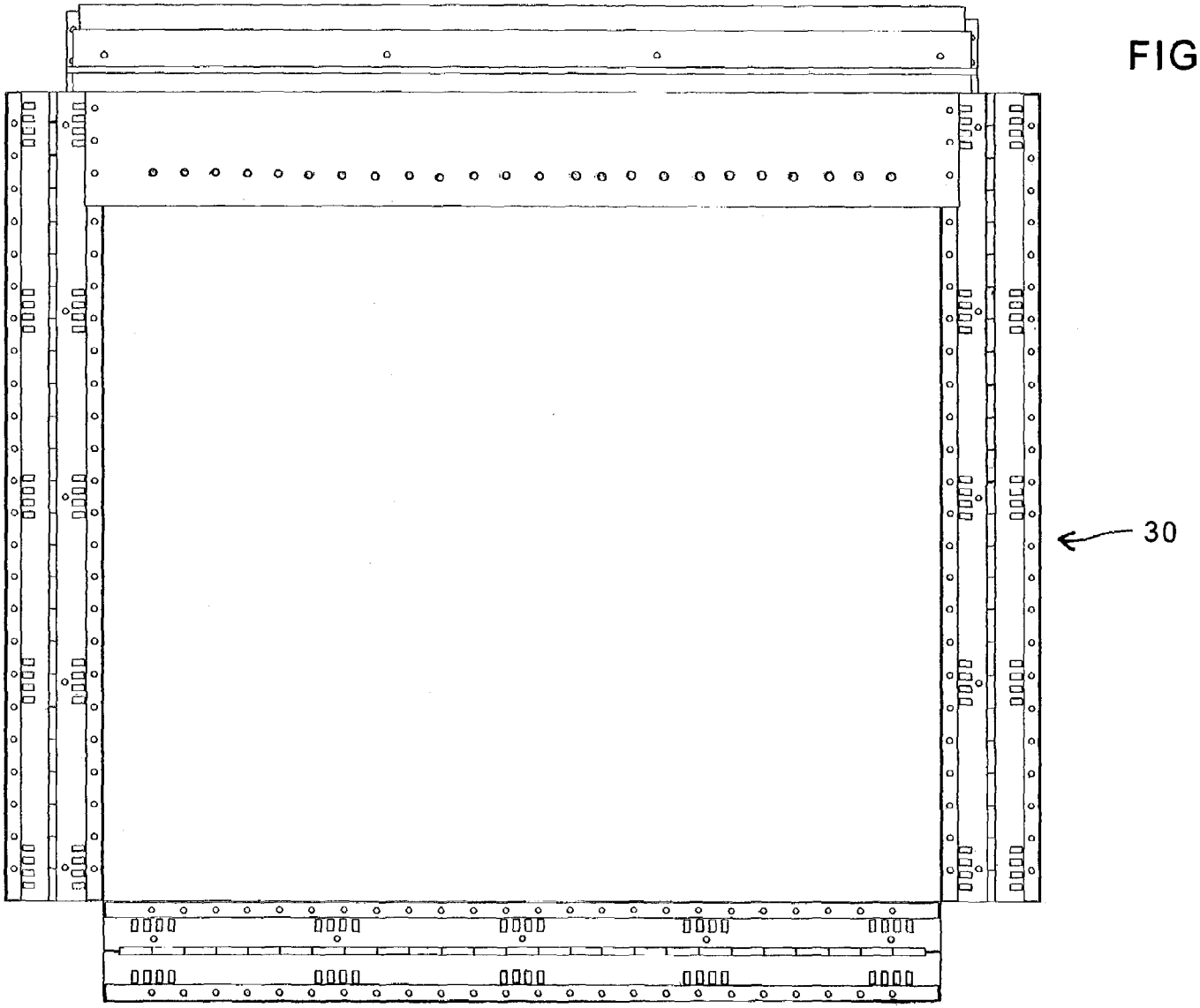
FIG. 8 shows a schematic illustration of a window arrangement.

FIG. 8 shows a schematic illustration of a window arrangement as detailed in FIG. 4.

Figure 8A:
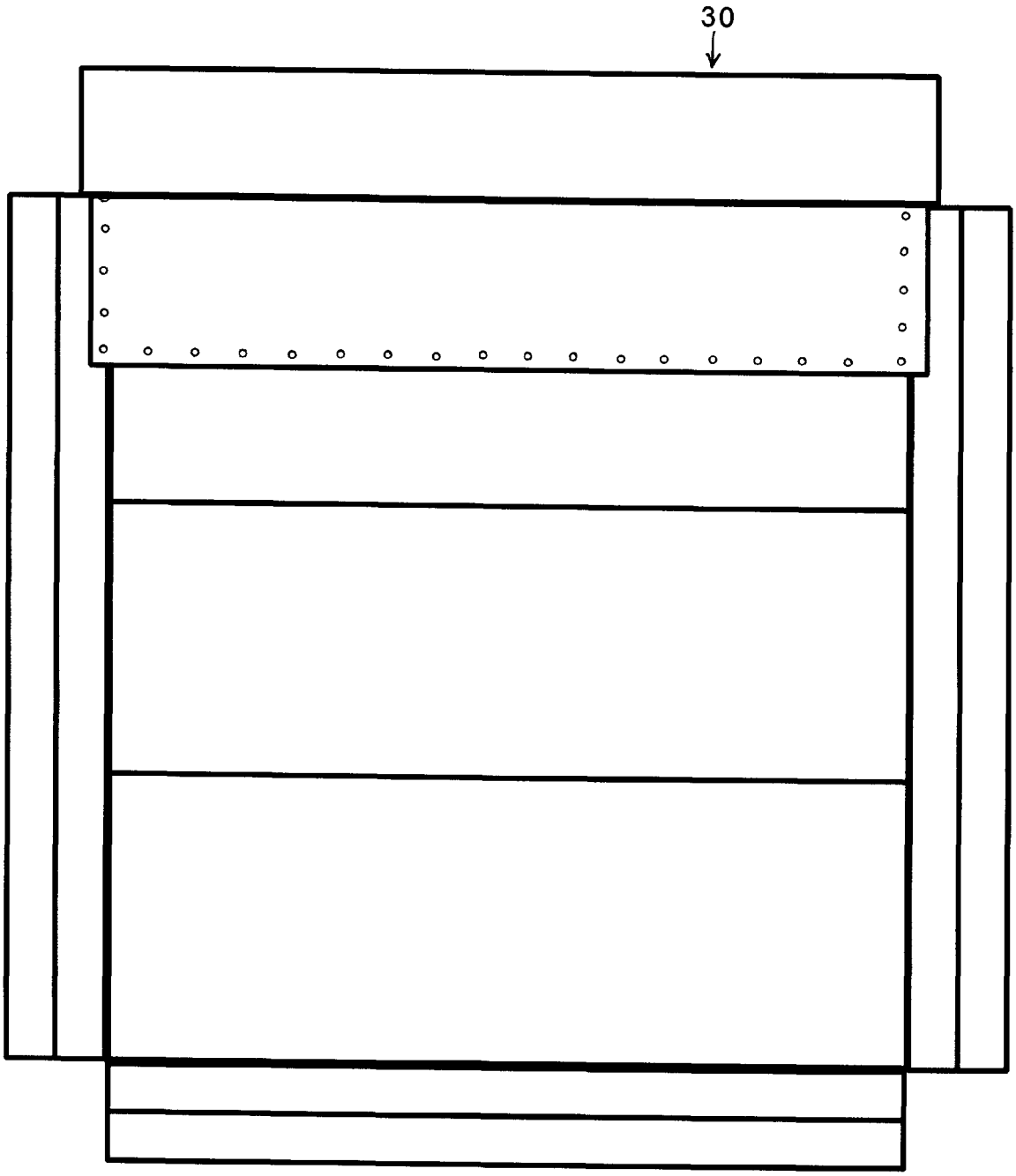
FIG. 8A shows a window arrangement installed on a jalousie window.

FIG. 8*a* shows a window arrangement installed on a jalousie window.

Figure 9:
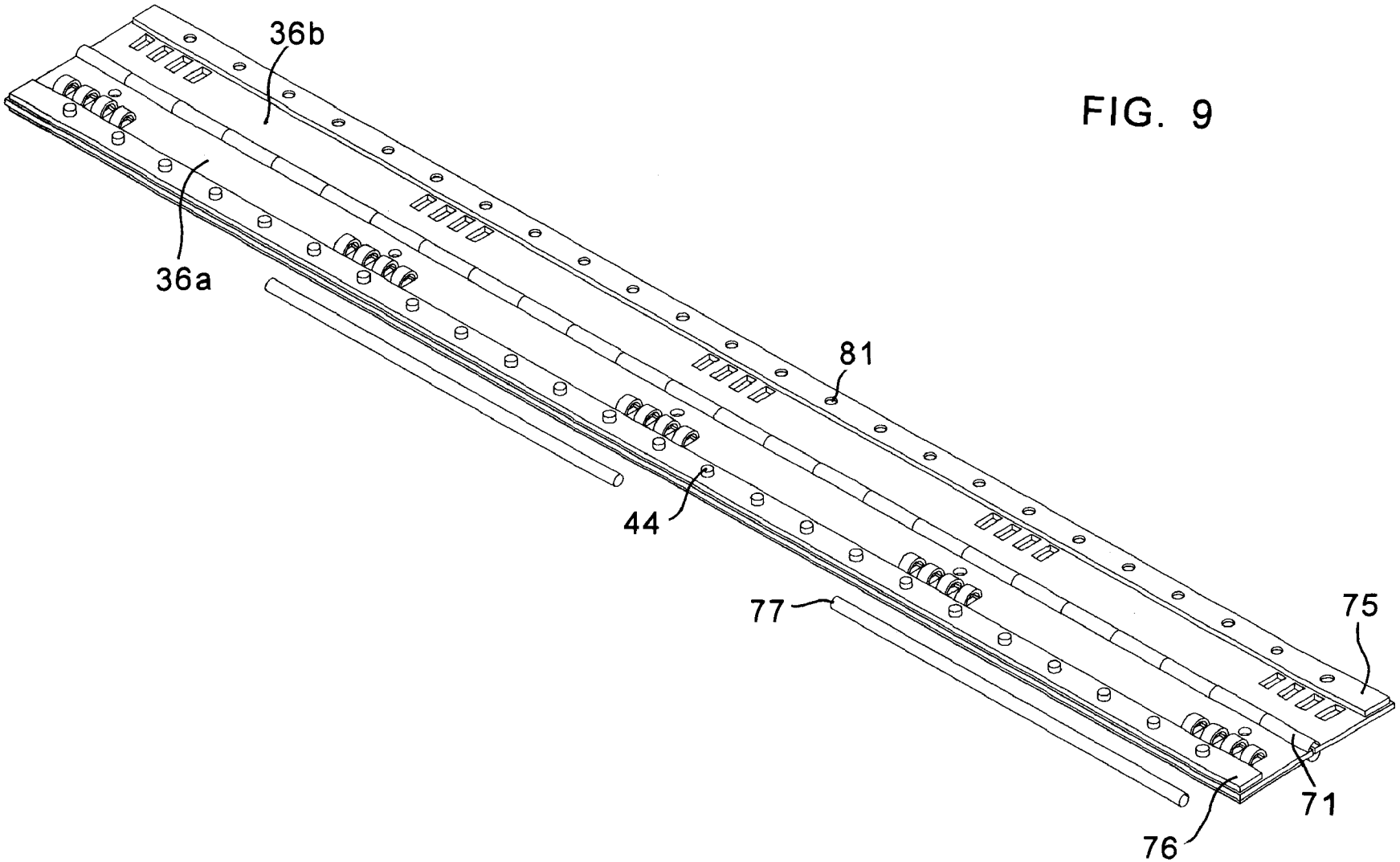
FIGS. 9, 9*a*, 9*b* and 10 are illustrations of framing members.
Figure 10:
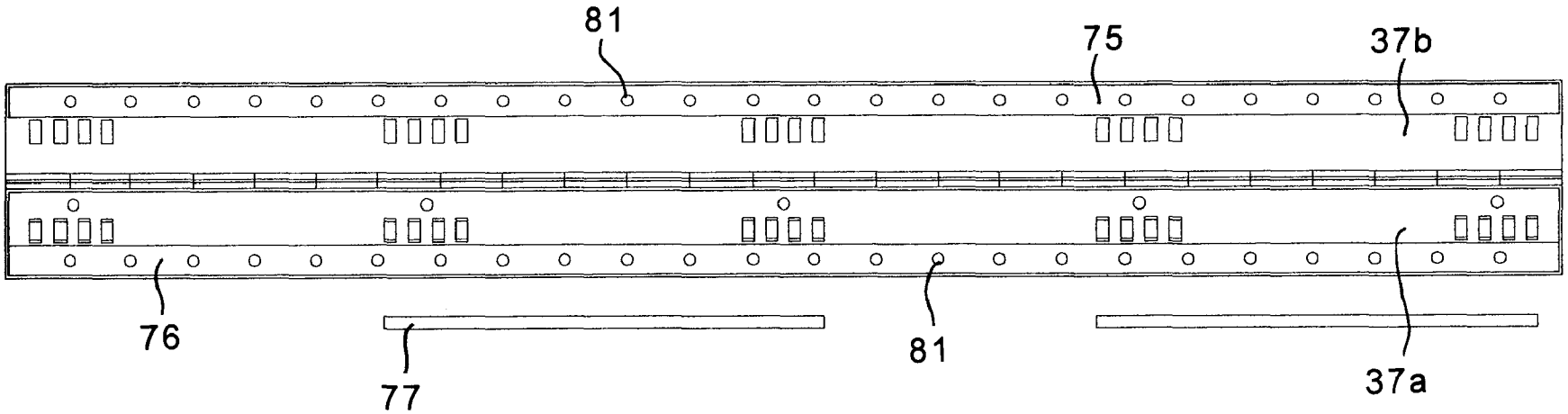

FIGS. 9 and 10 shows stationary leaf member 36*a* and folding leaf member 36*b* connected by a hinge 71. Along the edge of stationary leaf members 36*a* and 36*b* are bands of weatherstripping 75 and 76. The weatherstripping 75 has small holes 81 which align with the openings 43 on the folding leaf members, and the weatherstripping 76 has holes 81 that align and fit over the pegs 44.

Figure 9A:
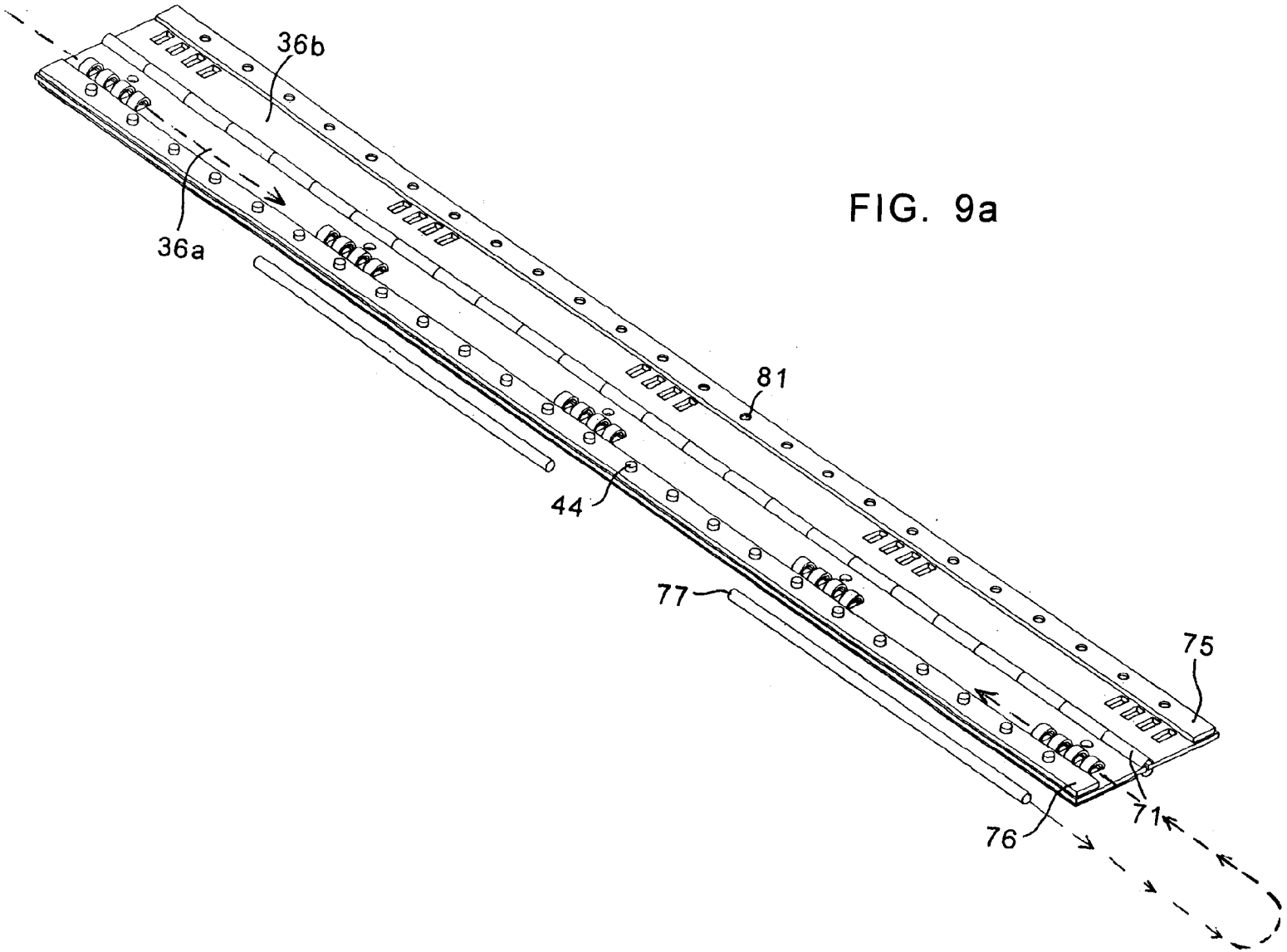
Figure 9B:
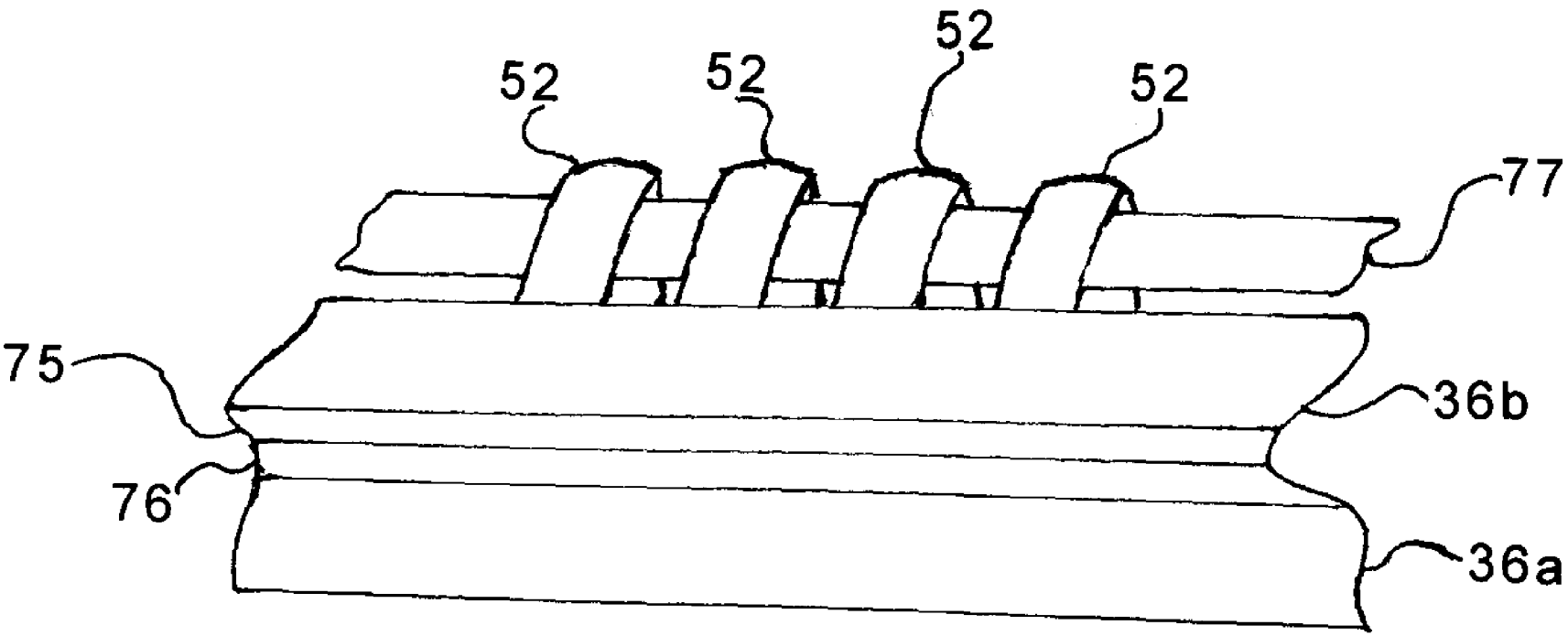

FIGS. 9*a* and 9*b* show pins 77, which can be inserted through arches 52 of stationary leaf members 36*a*, so as to essentially effect a locked position after the retractable sheet member 32 has been "sandwiched" between stationary leaf member 36*a* and folding leaf member 36*b*. Once the folding leaf members 36*b* and 37*b* are folded over to correspondingly mate with stationary leaf members 36*a* and 37*a*, the arches 52 substantially protrude through the corresponding channels 53 of the folding leaf members 36*b* and 37*b*. In this manner, the arches 52 essentially serve as "eyelets" through which the pins 77 can be inserted, thus preventing the members from separating.

Figure 11:
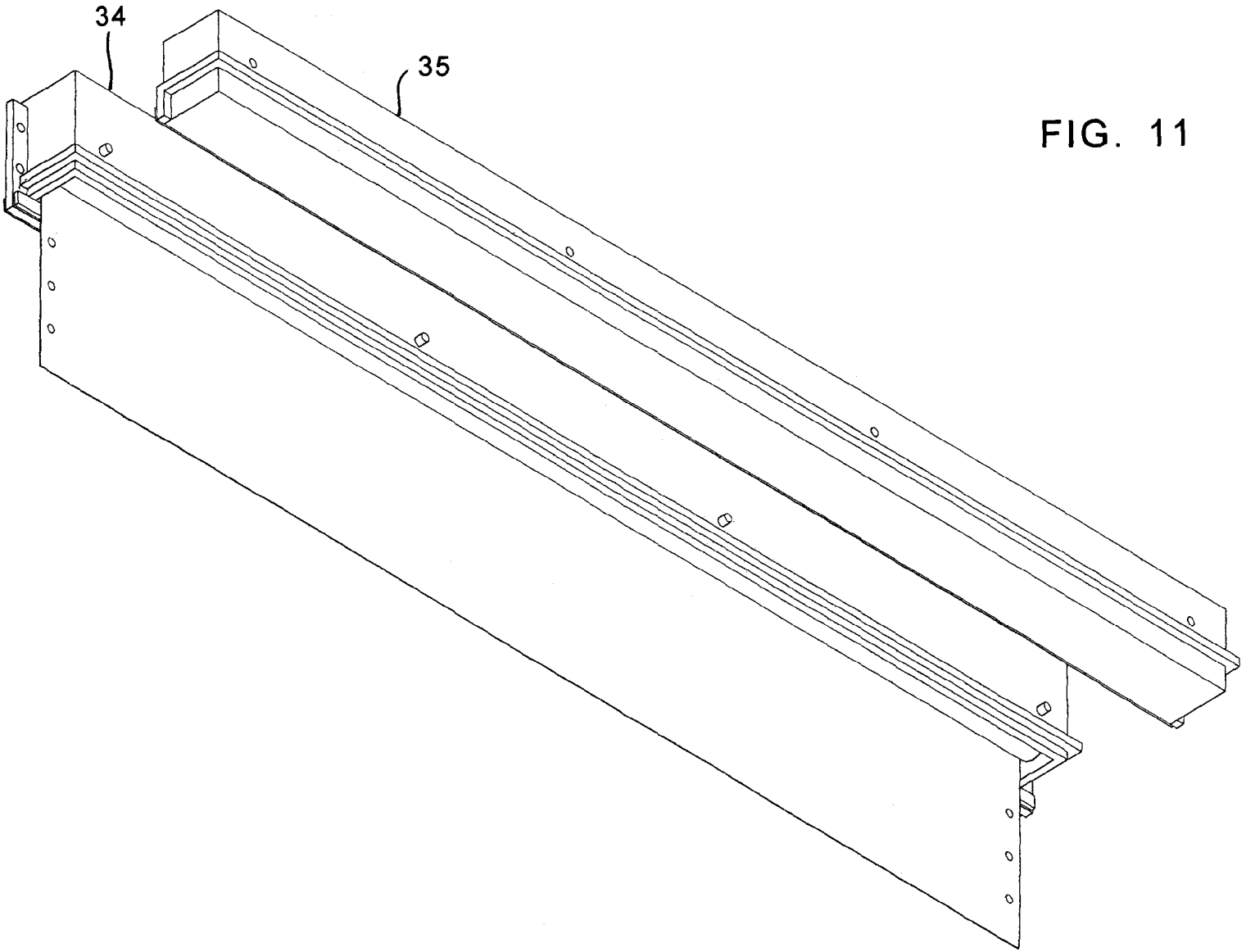
FIGS. 11-14 show various illustrations of housing units and housing unit mates.
Figure 12:
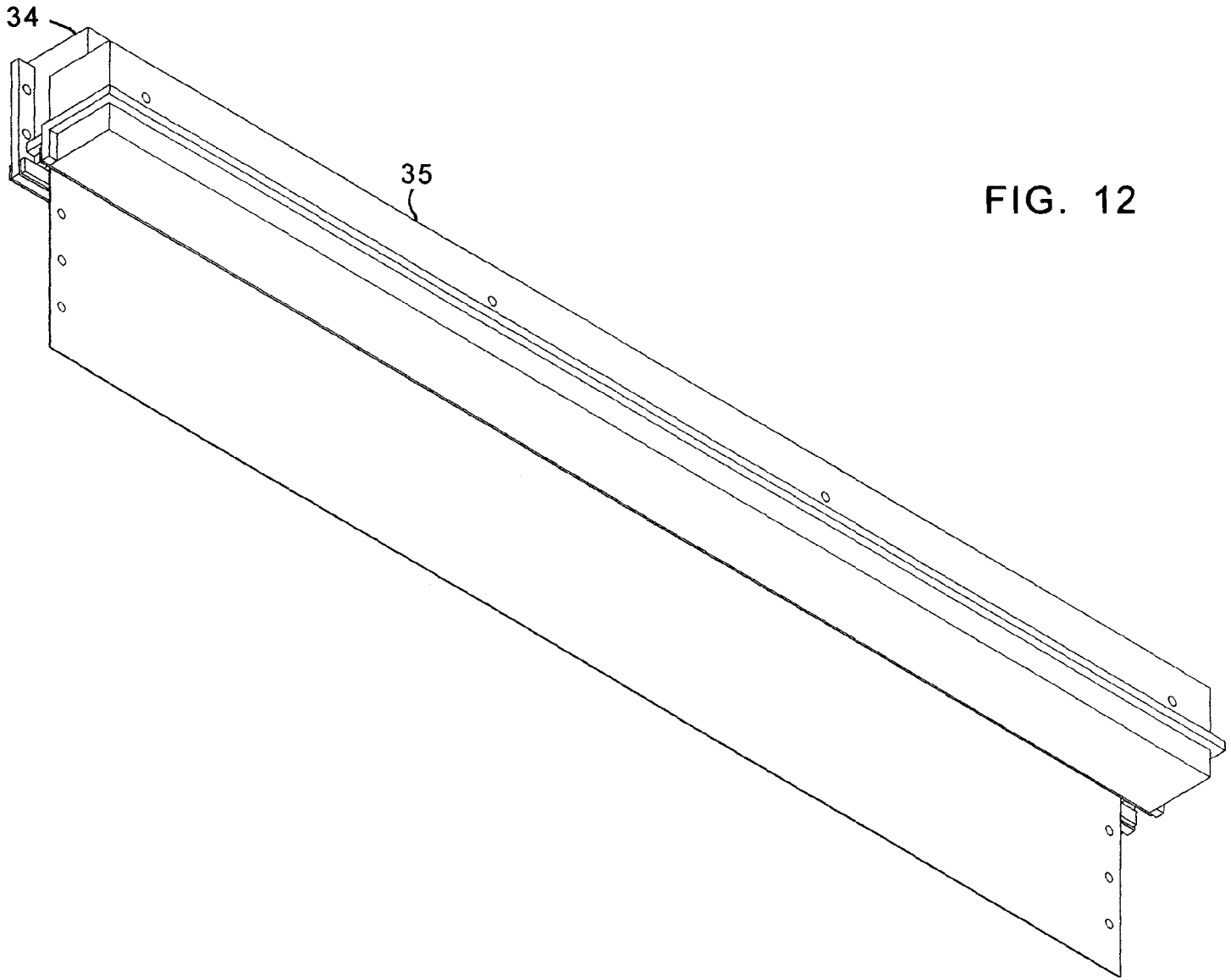
Figure 13:
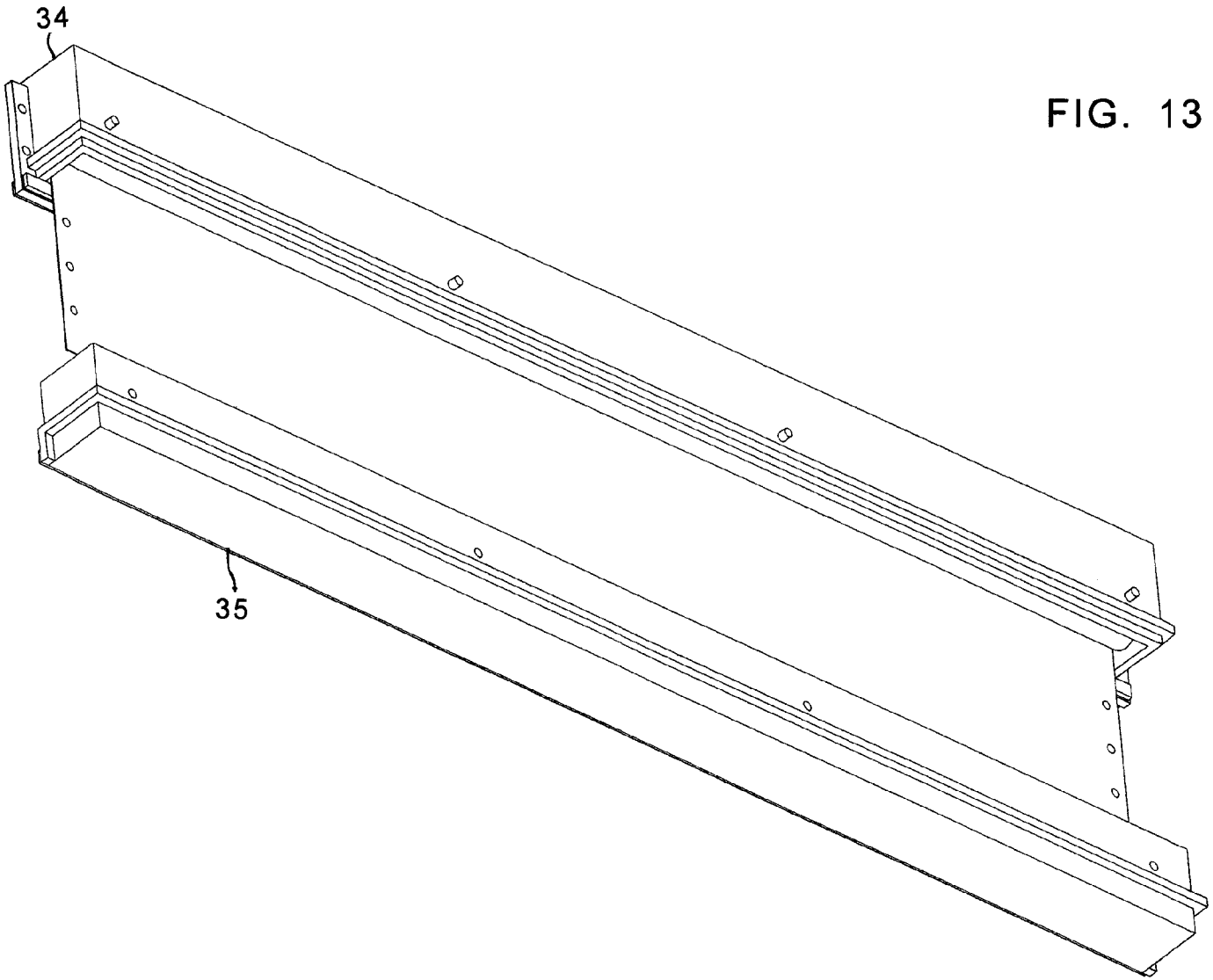
Figure 14:
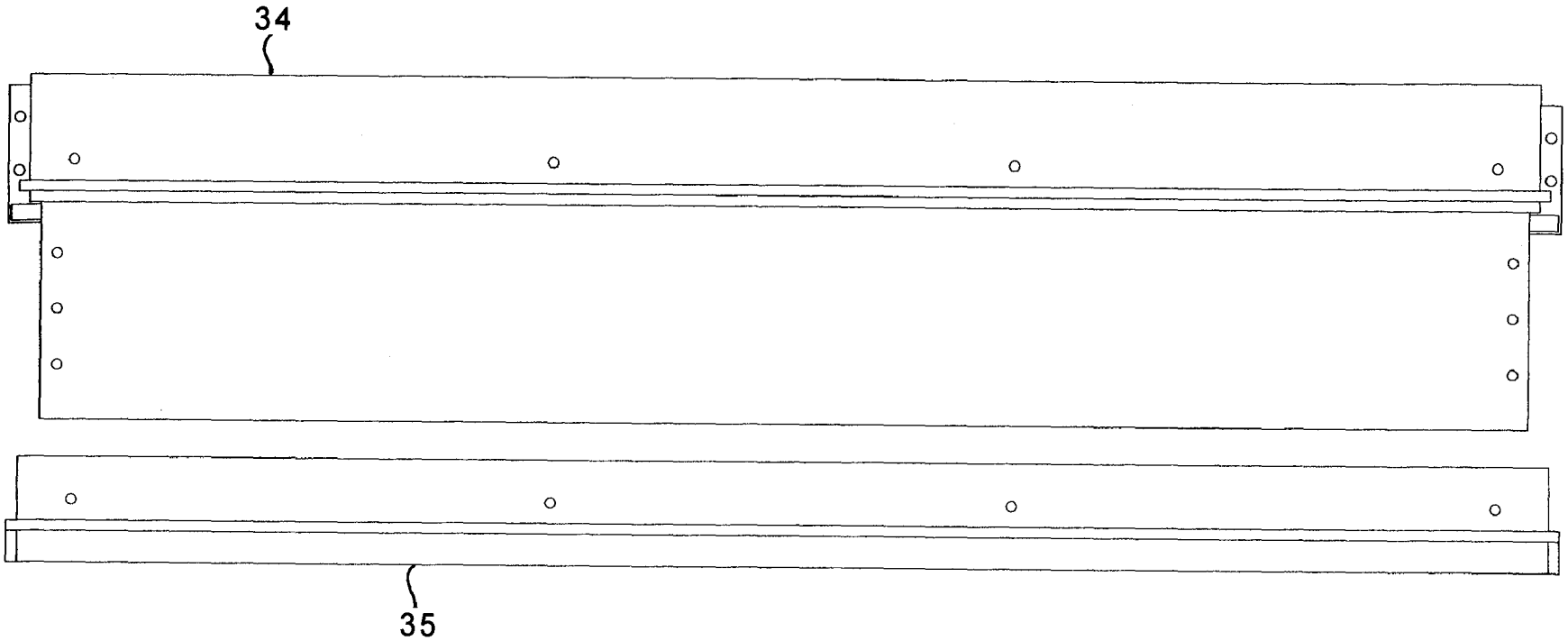

FIGS. 11, 12, 13, and 14 show the housing unit 34 and the housing unit mating section 35. FIGS. 11, 13, and 14 show the housing unit 34 and the housing unit mating section 35 in a separate, unlocked position. FIG. 12 shows them in a joined, locked position.

In at least one possible embodiment of the present application, it would be advantageous that the sheet member 32 would stop in an appropriate retracted position.

One feature or aspect of an embodiment is believed at the time of the filing of this patent application to possibly reside broadly in a building comprising: walls; a foundation structure being configured and disposed to support said walls; a roof; and windows; said windows comprising jalousie windows; said jalousie windows comprising a first jalousie window; said first jalousie window comprising: a window frame; said window frame comprising an interior surface; at least one window arrangement being configured and disposed to aid in the reduction of unwanted air movement in or out of windows; said at least one window arrangement being disposed on said interior window frame surface; louver panels being configured and disposed to open outwardly; said at least one window arrangement being configured to reduce flow of air through a window comprising: a roller mechanism; a sheet member; a housing unit; a housing unit mating section; at least three framing members; said sheet member of said window arrangement comprising a transparent flexible plastic material being configured to downwardly extend and upwardly retract; said sheet member material comprising a peripheral edge; said peripheral edge of said sheet member material comprising mooring holes being disposed linearly in and along said peripheral edge of said sheet member material and being configured to hold said sheet member material in a downwardly extended position; said housing unit of said window arrangement being configured and disposed to encompass and conceal said sheet member upon said sheet member being disposed in an upwardly retracted position; said housing unit having a length dimension and a width dimension; said housing unit comprising: a first weatherstripping; studs; end portions; said first weatherstripping of said housing unit being disposed linearly along the length dimension of said housing unit; said end portions of said housing unit being disposed adjacent the length dimension of said housing unit and perpendicular to the width dimension of said housing unit; said end portions comprising a second weatherstripping and fastener openings; said fastener openings of said end portions being disposed linearly in and along said end portions and being configured to receive fasteners to secure said housing unit to said window frame; said studs of said housing unit being disposed linearly along the length dimension of said housing unit; said housing unit having a crease being disposed linearly along the length dimension of said housing unit; said housing unit mating section of said window arrangement being configured and disposed adjacent said housing unit; said housing unit mating section having a length dimension and a width dimension; said housing unit mating section having a ridge being disposed linearly along the length dimension of said housing unit mating section; said housing unit mating section comprising: a third weatherstripping; holes; said third weatherstripping of said housing unit mating section being disposed linearly along the length dimension of said housing unit mating section; said holes of said housing unit mating section being disposed linearly along the length dimension of said housing unit mating section; said studs of said housing unit and said holes of said housing unit mating section being configured and disposed to mate and fit together, effecting a locked position; the crease of said housing unit and said ridge of said housing unit mating section being configured and disposed to correspondingly guide said studs of said housing unit into said holes of said housing unit mating section; said first weatherstripping of said housing unit and said third weatherstripping of said housing unit mating section being configured and disposed to seal said sheet member; said housing unit of said window arrangement and said at least three framing members of said window arrangement comprising a rectangle, being disposed adjacent said at least one interior window frame surface; said at least three framing members of said window arrangement comprising: stationary leaf members; folding leaf members; hinges; at least two framing members being disposed adjacent and perpendicular to said housing unit; at least one framing member being disposed adjacent and perpendicular to said two framing members; said stationary leaf members of said framing members being disposed adjacent said folding leaf members of said framing members; said stationary leaf members having a length dimension and a width dimension; said stationary leaf members comprising: pegs; a fourth weatherstripping; arches; fastener openings being disposed linearly in and along said stationary leaf members and being configured to receive fasteners to secure said framing members to said window frame; said pegs of said stationary leaf members being disposed linearly along the length dimension of said stationary leaf members; said fourth weatherstripping of said stationary leaf members being disposed linearly along the length dimension of said stationary leaf members; said fourth weatherstripping of said stationary leaf members comprising holes corresponding to said pegs of said stationary leaf members; said fourth weatherstripping of said stationary leaf members being disposed over said pegs on said stationary leaf members; said folding leaf members of said framing members having a length dimension and a width dimension; said folding leaf members comprising: openings; a fifth weatherstripping; channels; said openings of said folding leaf members being disposed linearly along the length dimension of said folding leaf members; said fifth weatherstripping of said folding leaf members being disposed linearly along the length dimension of said folding leaf members; said fifth weatherstripping of said folding leaf members comprising holes corresponding to said openings of said folding leaf members; said stationary leaf members and said folding leaf members connected by said hinges of said framing members; said mooring holes of said sheet member material being configured to fit over said pegs of said stationary leaf members; said folding leaf members configured to fold over said stationary leaf members; said channels of said folding leaf members being configured to mate and fit together with said arches of said stationary leaf members, guiding said openings of said folding leaf members onto said pegs of said stationary leaf members; said arches of said stationary leaf members configured to protrude through said channels of said folding leaf members; said at least one window arrangement comprises pins; said pins configured to fit into said arches, holding said arches in a protruding position through said channels of said folding leaf members; said stationary leaf members and said folding leaf members held together by said pins, thus preventing said stationary leaf members from separating from said folding leaf members; and said openings of said folding leaf members configured to mate and fit together with said pegs of said stationary leaf members, effecting a locked position, thereby locking said sheet member in a stationary position.

Another feature or aspect of an embodiment is believed at the time of the filing of this patent application to possibly reside broadly in the building, wherein said windows comprise one or more, or a plurality, of the following: double-hung windows, casement windows, hopper windows, or awning windows.

Yet another feature or aspect of an embodiment is believed at the time of the filing of this patent application to possibly reside broadly in the building, wherein said stationary leaf members and said folding leaf members comprise a two-inch width.

Still another feature or aspect of an embodiment is believed at the time of the filing of this patent application to possibly reside broadly in the building, wherein said sheet member comprises one of the following: a transparent, plastic material; an opaque, light-blocking material; or an air-permeable material.

A further feature or aspect of an embodiment is believed at the time of the filing of this patent application to possibly reside broadly in the building, wherein: said roller mechanism comprises a first roller mechanism; said sheet member comprises a first sheet member; said window arrangement comprises a second roller mechanism and a second sheet member; each of said sheet members comprises one of: a transparent, plastic material; an opaque, light-blocking material; or an air-permeable material; and said first sheet member comprises a different material than said second sheet member.

Another feature or aspect of an embodiment is believed at the time of the filing of this patent application to possibly reside broadly in the building, wherein: said window arrangement comprises a third roller mechanism and a third sheet member; said sheet member comprises one of: a transparent, plastic material; an opaque, light-blocking material; or an air-permeable material; and said third sheet member comprises a different material than said first or said second sheet member.

Yet another feature or aspect of an embodiment is believed at the time of the filing of this patent application to possibly reside broadly in a window arrangement being configured to reduce flow of air through a window, said window screen comprising: a frame; a sheet member comprising a flexible plastic material being configured to be extended downwardly and retracted upwardly; a roller mechanism being configured and disposed to hold said screen member; said sheet member comprising at least three sheet member peripheral edges; one of said at least three sheet member peripheral edges comprising a first sheet member peripheral edge; said first sheet member peripheral edge comprising mooring holes being disposed in and along the length thereof; said frame comprising at least three frame peripheral edges; one of said at least three frame peripheral edges comprising a first frame peripheral edge; said frame comprising pegs being disposed along said first frame peripheral edge and being configured to project outwardly from said frame; each of said mooring holes of said sheet member being configured to fit over a corresponding one of said pegs; said pegs being configured to fit into said mooring holes, to hold said screen member in a downwardly extended position; said frame comprising at least one folding leaf member being configured to fold over said frame; said at least one folding leaf member comprising a first folding leaf member; said first folding leaf member being disposed adjacent said first frame peripheral edge; said first folding leaf member comprising openings being disposed in and along the length thereof; each of said openings being configured to meet with a corresponding one of said mooring holes and fit over a corresponding one of said pegs; said openings of said first folding leaf member being configured to receive and mate with said pegs; and said first folding leaf member being configured to clamp said mooring holes of said sheet member to hold said sheet member in place.

Still another feature or aspect of an embodiment is believed at the time of the filing of this patent application to possibly reside broadly in the window arrangement, wherein said sheet member comprises a second sheet member peripheral edge; said second sheet member peripheral edge comprising mooring holes being disposed in and along the length thereof.

A further feature or aspect of an embodiment is believed at the time of the filing of this patent application to possibly reside broadly in the window arrangement, wherein said frame comprises a second frame peripheral edge; said second frame peripheral edges comprising pegs being disposed along said edge and being configured to project outwardly from said frame; and each of said mooring holes of said sheet member being configured to fit over a corresponding one of said pegs.

Another feature or aspect of an embodiment is believed at the time of the filing of this patent application to possibly reside broadly in the window arrangement, wherein said frame comprises a second folding leaf member; said second folding leaf member being disposed adjacent said second frame peripheral edge; said second folding leaf member comprising openings being disposed in and along the length thereof; and each of said openings being configured to meet with a corresponding one of said mooring holes and fit over a corresponding one of said pegs.

Yet another feature or aspect of an embodiment is believed at the time of the filing of this patent application to possibly reside broadly in the window arrangement, wherein said sheet member comprises a third sheet member peripheral edge; said third sheet member peripheral edge comprising mooring holes being disposed in and along the length thereof.

Still another feature or aspect of an embodiment is believed at the time of the filing of this patent application to possibly reside broadly in the window arrangement, wherein said frame comprising a third frame peripheral edge; said third frame peripheral edge comprising pegs being disposed along said edge and being configured to project outwardly from said frame; and each of said mooring holes of said sheet member being configured to fit over a corresponding one of said pegs.

A further feature or aspect of an embodiment is believed at the time of the filing of this patent application to possibly reside broadly in the window arrangement, wherein said frame comprises a third folding leaf member; said third folding leaf member being disposed adjacent said third frame peripheral edge; said third folding leaf member comprising openings being disposed in and along the length thereof; and each of said openings being configured to meet with a corresponding one of said mooring holes and fit over a corresponding one of said pegs.

Another feature or aspect of an embodiment is believed at the time of the filing of this patent application to possibly reside broadly in the window arrangement, wherein said window arrangement comprises a housing unit being configured and disposed to hold said sheet member.

Yet another feature or aspect of an embodiment is believed at the time of the filing of this patent application to possibly reside broadly in the window arrangement, wherein said sheet member comprises one of the following: a transparent, plastic material; an opaque, light-blocking material; or an air-permeable material.

Still another feature or aspect of an embodiment is believed at the time of the filing of this patent application to possibly reside broadly in the window arrangement, wherein said frame comprises hinges being configured and disposed to connect said folding leaf members to said window arrangement.

A further feature or aspect of an embodiment is believed at the time of the filing of this patent application to possibly reside broadly in the window arrangement, wherein said folding leaf members comprise weatherstripping being disposed along the lengths thereof.

Another feature or aspect of an embodiment is believed at the time of the filing of this patent application to possibly reside broadly in the window arrangement, wherein said roller mechanism comprises a first roller mechanism; said sheet member comprises a first sheet member; said window arrangement comprises a second roller mechanism and a second sheet member; each of said sheet members comprise one of: a transparent, plastic material; an opaque, light-blocking material; or an air-permeable material; and said first sheet member comprises a different material than said second sheet member.

Yet another feature or aspect of an embodiment is believed at the time of the filing of this patent application to possibly reside broadly in the window arrangement, wherein said window arrangement comprises a third roller mechanism and a third sheet member; said sheet member comprises one of: a transparent, plastic material; an opaque, light-blocking material; or an air-permeable material; and said third sheet member comprises a different material than said first or said second sheet member.

Still another feature or aspect of an embodiment is believed at the time of the filing of this patent application to possibly reside broadly in the window arrangement, wherein said window arrangement comprises a frame being configured to fit a door opening.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of roller mechanisms that may possibly be utilized or adapted for use in at least one possible embodiment may possibly be found in the following U.S. patents: U.S. Pat. No. 6,971,435, entitled "Raising and lowering mechanism, in particular for roller blinds;" U.S. Pat. No. 6,474,395, entitled "Manufacture of roller-blinds for vehicles;" U.S. Pat. No. 6,467,714, entitled "Winding mechanism for roller blinds;" U.S. Pat. No. 6,212,913, entitled "Manufacture of roller-blinds;" U.S. Pat. No. 5,975,186, entitled "Roller blinds mountings;" U.S. Pat. No. 5,443,563, entitled "Roller blinds and processes for their manufacture;" U.S. Pat. No. 5,343,922, entitled "Slatted curtain for roller blinds;" U.S. Pat. No. 5,167,269, entitled "Roller mechanism for roller blinds;" U.S. Pat. No. 4,850,418, entitled "Brake release mechanism for motor operated roller blinds and shutters;" U.S. Pat. No. 4,846,248, entitled "Strap winder, in particular for skylight roller blinds;" U.S. Pat. No. D299,114, entitled "Packaging container for roller blinds;" U.S. Pat. No. 4,732,201, entitled "Roller blinds;" U.S. Pat. No. 4,665,965, entitled "Control system for roller-blinds or the like with swivel blades;" U.S. Pat. No. 4,513,805, entitled "Decelerator for use in roller blinds;" U.S. Pat. No. 4,462,778, entitled "Extrusion head for extruding mouldings for roller blinds, frames, finish and the like;" U.S. Pat. No. 4,401,146, entitled "Roller blinds;" U.S. Pat. No. 4,372,367, entitled "Roller blinds," U.S. Pat. No. 4,347,886, entitled "Roller blinds;" U.S. Pat. No. 4,262,729, entitled "Roller blinds;" U.S. Pat. No. 4,238,969, entitled "Mechanical gearing for roller blinds and awnings;" U.S. Pat. No. 4,172,563, entitled "Shut-off unit in a drive unit for awnings and roller blinds;" U.S. Pat. No. 4,125,142, entitled "Safety device protecting roller blinds against unrolling;" U.S. Pat. No. 4,112,996, entitled "Safety device for arresting unrolling of roller blinds;" and U.S. Pat. No. 4,079,597, entitled "Drive unit for awnings and roller blinds."

All, or substantially all, of the components and methods of the various embodiments may be used with at least one embodiment or all of the embodiments, if more than one embodiment is described herein.

Some examples of jalousie windows that may possibly be utilized or adapted for use in at least one possible embodiment may possibly be found in the following U.S. patents: U.S. Pat. No. 7,104,010, entitled "Hermetic jalousie window hardware;" U.S. Pat. No. 6,098,339, entitled "Reinforced jalousie window with spaced wall side jambs for pivot support;" U.S. Pat. No. 6,061,962, entitled "Operating assembly for jalousie window with negative pressure lock;" U.S. Pat. No. 5,907,926, entitled "Operating assembly for jalousie window;" U.S. Pat. No. 4,813,183, entitled "Dual louver blade jalousie window;" U.S. Pat. No. 4,688,351, entitled "Security window of the jalousie variety;" U.S. Pat. No. 7,104,010, entitled "Hermetic jalousie window hardware;" U.S. Pat. No. 6,966,158, entitled "Universal window/door frame;" U.S. Pat. No. 6,098,339, entitled "Reinforced jalousie window with spaced wall side jambs for pivot support;" U.S. Pat. No. 6,061,962, entitled "Operating assembly for jalousie window with negative pressure lock;" U.S. Pat. No. 5,907,926, entitled "Operating assembly for jalousie window;" U.S. Pat. No. 4,991,349, entitled "Insulating window for mobile homes;" U.S. Pat. No. 4,813,183, entitled "Dual louver blade jalousie window;" U.S. Pat. No. 4,688,351, entitled "Security window of the jalousie variety;" U.S. Pat. No. 4,505,079, entitled "Thermal window shield;" U.S. Pat. No. 4,449,121, entitled "Jalousie with integral alarm circuit;" U.S. Pat. No. 4,087,929, entitled "Jalousie structure;" U.S. Pat. No. 3,994,095, entitled "Safety window;" and U.S. Pat. No. 3,954,023, entitled "Automatic lock and release mechanism for opening movable-slat windows."

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of casement windows that may possibly be utilized or adapted for use in at least one possible embodiment may possibly be found in the following U.S. patents: U.S. Pat. No. 7,100,327, entitled "Casement window system and components and hardware therefor;" U.S. Pat. No. 7,036,274, entitled "Casement window opening and closing assembly;" U.S. Pat. No. 7,000,955, entitled "Portable casement window securing device;" U.S. Pat. No. 6,843,023, entitled "Dual casement window structure;" U.S. Pat. No. D497,304, entitled "Cover for a casement window handle;" U.S. Pat. No. D494,835, entitled "Casement window crank handle;" U.S. Pat. No. D492,795, entitled "Casement window;" U.S. Pat. No. D487,012, entitled "Casement window folding handle;" U.S. Pat. No. D484,787, entitled "Casement window operator cover;" U.S. Pat. No. 6,672,010, entitled "Casement window operator with adjustable bushing;" U.S. Pat. No. 6,651,389, entitled "Casement window with improved tie bar guide and striker;" U.S. Pat. No. 6,640,389, entitled "Casement window operating assembly;" U.S. Pat. No. D477,882, entitled "Casement window;" U.S. Pat. No. D476,882, entitled "Casement window operator;" U.S. Pat. No. 6,427,415, entitled "Casement frame for a window;" U.S. Pat. No. D459,982, entitled "Combined folding crank handle and cover assembly for a casement window operator;" U.S. Pat. No. D459,193, entitled "Outer surface of a cover for a casement window operator;" U.S. Pat. No. 6,375,382, entitled "Crank handle assembly for casement window;" U.S. Pat. No. 6,374,544, entitled "Window actuator for casement type window;" U.S. Pat. No. D452,999, entitled "Outer surface of a cover for a casement window operator;" U.S. Pat. No. D450,237, entitled "Combined folding crank handle and cover assembly for a casement window operator;" U.S. Pat. No. 6,247,270, entitled "Casement window roto-operators;" U.S. Pat. No. D440,143, entitled "Casement window lock handle;" U.S. Pat. No. 6,081,965, entitled "Braking mechanism for the casement of a window or door;" U.S. Pat. No. 5,964,011, entitled "Adjustable casement window hinge;" U.S. Pat. No. D414,278, entitled "Fixed casement window frame component;" U.S. Pat. No. 5,829,802, entitled "Multi-point lock operator for casement window;" U.S. Pat. No. 5,815,984, entitled "Casement window operator;" U.S. Pat. No. D394,714, entitled "Casement window;" U.S. Pat. No. D378,855, entitled "Casement window frame component;" U.S. Pat. No. D378,854, entitled "Casement window frame component;" U.S. Pat. No. D378,545, entitled "Fixed casement window frame component;" U.S. Pat. No. D378,138, entitled "Casement window sash component;" U.S. Pat. No. 5,603,538, entitled "Casement window sash locking system;" U.S. Pat. No. 5,560,148, entitled "Dual axle linkage mechanism for door and casement window;" U.S. Pat. No. 5,553,420, entitled "Casement window;" U.S. Pat. No. 5,398,446, entitled "Window with openable casement;" and U.S. Pat. No. 5,289,656, entitled "Geared casement window hinges."

All of the patents, patent applications and publications recited herein, and in the Declaration attached hereto, are hereby incorporated by reference as if set forth in their entirety herein.

Some examples of double-hung windows that may possibly be utilized or adapted for use in at least one possible embodiment may possibly be found in the following U.S. patents: U.S. Pat. No. 6,199,323, entitled "Double-hung window structure and seals;" U.S. Pat. No. 6,139,071, entitled "Locking system for a double-hung window;" U.S. Pat. No. 5,901,499, entitled "Double-hung window locking system;" U.S. Pat. No. 5,855,092, entitled "Sash brake for double-hung window with pivoting sash;" U.S. Pat. No. 5,566,507, entitled "Double-hung tilting sash type window system;" U.S. Pat. No. 5,544,450, entitled "Double-hung tilting sash type window system;" U.S. Pat. No. 5,035,081, entitled "Double-hung window;" U.S. Pat. No. 4,923,230, entitled "Self-contained security lock for double-hung window;" U.S. Pat. No. 4,824,154, entitled "Security lock for double-hung window;" U.S. Pat. No. 4,813,180, entitled "Double-hung window pivot;" U.S. Pat. No. 4,685,175, entitled "Spring system for double-hung window sash;" U.S. Pat. No. 4,606,147, entitled "Sealing jamb liner for double-hung window sash;" U.S. Pat. No. 4,464,864, entitled "Weatherstripping in a double-hung window;" U.S. Pat. No. 4,304,072, entitled "Double-hung replacement window unit;" and U.S. Pat. No. 4,274,468, entitled "Triple-sash double-hung storm window."

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of hopper windows that may possibly be utilized or adapted for use in at least one possible embodiment may possibly be found in the following U.S. patents: U.S. Pat. No. 5,651,215, entitled "Hopper window;" and U.S. Pat. No. 5,575,114, entitled "Hopper window."

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of awning windows that may possibly be utilized or adapted for use in at least one possible embodiment may possibly be found in the following U.S. patents: U.S. Pat. No. 6,478,072, entitled "Solar screen mounting for an awning window;" U.S. Pat. No. 6,088,880, entitled "Adjustable shoe for awning window hinge;" U.S. Pat. No. D420,889, entitled "Awning window operator;" U.S. Pat. No. 5,899,021, entitled "Awning window;" U.S. Pat. No. 5,339,568, entitled "Awning window assembly and operator therefor;" U.S. Pat. No. 4,855,716, entitled "Security awning window;" and U.S. Pat. No. 4,039,018, entitled "Awning window construction."

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

SEQUENCE LISTING

Not Applicable

What is claimed is:

1. A window arrangement being configured to reduce flow of air through a window, said window arrangement comprising:

a frame;

a sheet member comprising a flexible plastic material extending downwardly and retracting upwardly;

a roller mechanism disposed to hold said sheet member;

said sheet member comprising a first sheet member peripheral edge, a second sheet member peripheral edge, and a third sheet member peripheral edge;

said first sheet member peripheral edge comprising mooring holes being disposed in and along the length thereof;

said frame comprising a first frame peripheral edge, a second frame peripheral edge, and a third frame peripheral edge;

said frame comprising pegs being disposed along said first frame peripheral edge and projecting outwardly from said frame;

each of said mooring holes of said sheet member fitting over a corresponding one of said pegs;

said pegs fitting into said mooring holes to hold said sheet member in a downwardly extended position;

said frame comprising a first folding leaf member, a second folding leaf member, and a third folding leaf member, which first folding leaf member is folding over said frame;

said first folding leaf member being disposed adjacent said first frame peripheral edge;

said first folding leaf member comprising openings being disposed in and along the length thereof;

each of said openings meeting with a corresponding one of said mooring holes and fit over a corresponding one of said pegs;

said openings of said first folding leaf member receive and mate with said pegs; and said first folding leaf member clamping said mooring holes of said first sheet member peripheral edge of said sheet member to hold said sheet member in place.

2. The window arrangement according to claim 1, wherein:

said second sheet member peripheral edge comprises mooring holes being disposed in and along the length thereof.

3. The window arrangement according to claim 2, wherein:

said second frame peripheral edge comprises pegs being disposed along said edge and being configured to project outwardly from said frame; and each of said mooring holes of said sheet member being configured to fit over a corresponding one of said pegs.

4. The window arrangement according to claim 3, wherein:

said second folding leaf member being disposed adjacent said second frame peripheral edge;

said second folding leaf member comprising openings being disposed in and along the length thereof; and each of said openings being configured to meet with a corresponding one of said mooring holes and fit over a corresponding one of said pegs.

5. The window arrangement according to claim 4, wherein:

said third sheet member peripheral edge comprising mooring holes being disposed in and along the length thereof.

6. The window arrangement according to claim 5, wherein:

said third frame peripheral edge comprising pegs being disposed along said edge and being configured to project outwardly from said frame; and each of said mooring holes of said sheet member being configured to fit over a corresponding one of said pegs.

7. The window arrangement according to claim 6, wherein:

said third folding leaf member being disposed adjacent said third frame peripheral edge;

said third folding leaf member comprising openings being disposed in and along the length thereof; and each of said openings being configured to meet with a corresponding one of said mooring holes and fit over a corresponding one of said pegs.

8. The window arrangement according to claim 7, wherein said window arrangement comprises a housing unit being configured and disposed to hold said sheet member.

9. The window arrangement according to claim 8, wherein said sheet member comprises one of the following:

a transparent, plastic material;

an opaque, light-blocking material; or an air-permeable material.

10. The window arrangement according to claim 9, wherein said frame comprises hinges being configured and disposed to connect said folding leaf members to said window arrangement.

11. The window arrangement according to claim 10, wherein said folding leaf members comprise weatherstripping being disposed along the lengths thereof.

12. The window arrangement according to claim 11, wherein said window arrangement comprises a frame being configured to fit a door opening.

13. A window arrangement being configured to reduce flow of air through a window, said window arrangement comprising:

a roller mechanism;

a sheet member;

a housing unit;

a housing unit mating section;

at least three framing members;

pins;

said sheet member comprising a transparent flexible plastic material being configured to downwardly extend and upwardly retract;

said sheet member material comprising a peripheral edge;

said peripheral edge of said sheet member material comprising mooring holes being disposed linearly in and along said peripheral edge of said sheet member material and being configured to hold said sheet member material in a downwardly extended position;

said housing unit being configured and disposed to encompass and conceal said sheet member upon said sheet member being disposed in an upwardly retracted position;

said housing unit having a length dimension and a width dimension;

said housing unit comprising a first weatherstripping, studs, and end portions;

said first weatherstripping being disposed linearly along the length dimension of said housing unit;

said end portions being disposed adjacent the length dimension of said housing unit and perpendicular to the width dimension of said housing unit;

said end portions comprising a second weatherstripping and fastener openings;

said fastener openings of said end portions being disposed linearly in and along said end portions and being configured to receive fasteners to secure said housing unit to a window frame;

said studs being disposed linearly along the length dimension of said housing unit;

said housing unit having a crease being disposed linearly along the length dimension of said housing unit;

said housing unit mating section being disposed adjacent said housing unit;

said housing unit mating section having a length dimension and a width dimension;

said housing unit mating section having a ridge being disposed linearly along the length dimension of said housing unit mating section;

said housing unit mating section comprising a third weatherstripping and holes;

said third weatherstripping being disposed linearly along the length dimension of said housing unit mating section;

said holes of said housing unit mating section being disposed linearly along the length dimension of said housing unit mating section;

said studs of said housing unit and said holes of said housing unit mating section being configured and disposed to mate and fit together to effect a locked position;

said crease of said housing unit and said ridge of said housing unit mating section being configured and disposed to correspondingly guide said studs of said housing unit into said holes of said housing unit mating section;

said first weatherstripping of said housing unit and said third weatherstripping of said housing unit mating section being configured and disposed to seal said sheet member;

said housing unit and said at least three framing members comprising a rectangle;

at least two framing members being disposed adjacent and perpendicular to said housing unit;

at least one framing member being disposed adjacent and perpendicular to said two framing members;

each of said at least three framing members comprising:

stationary leaf members;

folding leaf members; and hinges;

said stationary leaf members of said framing members being disposed adjacent said folding leaf members of said framing members;

said stationary leaf members having a length dimension and a width dimension;

said stationary leaf members comprising:

pegs;

a fourth weatherstripping;

arches; and fastener openings;

said fastener openings being disposed linearly in and along said stationary leaf members and being configured to receive fasteners to secure said framing members to a window frame;

said pegs of said stationary leaf members being disposed linearly along the length dimension of said stationary leaf members;

said fourth weatherstripping of said stationary leaf members being disposed linearly along the length dimension of said stationary leaf members;

said fourth weatherstripping of said stationary leaf members comprising holes corresponding to said pegs of said stationary leaf members;

said fourth weatherstripping of said stationary leaf members being disposed over said pegs on said stationary leaf members;

said folding leaf members of said framing members having a length dimension and a width dimension;

said folding leaf members comprising:

openings;

a fifth weatherstripping; and channels;

said openings of said folding leaf members being disposed linearly along the length dimension of said folding leaf members;

said fifth weatherstripping of said folding leaf members being disposed linearly along the length dimension of said folding leaf members; and said fifth weatherstripping of said folding leaf members comprising holes corresponding to said openings of said folding leaf members;

said stationary leaf members and said folding leaf members being connected by said hinges of said framing members;

said mooring holes of said sheet member material being configured to fit over said pegs of said stationary leaf members;

said folding leaf members configured to fold over said stationary leaf members;

said channels of said folding leaf members being configured to mate and fit together with said arches of said stationary leaf members, guiding said openings of said folding leaf members onto said pegs of said stationary leaf members;

said arches of said stationary leaf members configured to protrude through said channels of said folding leaf members;

said pins being configured and disposed to fit into said arches to hold said arches in a protruding position through said channels of said folding leaf members;

said stationary leaf members and said folding leaf members being held together by said pins to prevent said stationary leaf members from separating from said folding leaf members; and said openings of said folding leaf members being configured to mate and fit together with said pegs of said stationary leaf members, effecting a locked position, thereby locking said sheet member in a stationary position.

14. The window arrangement according to claim 13, wherein said stationary leaf members and said folding leaf members each have a two-inch width.

15. The window arrangement according to claim 14, wherein said sheet member comprises one of:

a transparent, plastic material;

an opaque, light-blocking material; and an air-permeable material.

* * * * *